US006194135B1

(12) United States Patent
Ly et al.

(10) Patent No.: US 6,194,135 B1
(45) Date of Patent: Feb. 27, 2001

(54) COLOR PHOTOGRAPHIC SILVER HALIDE MATERIAL

(75) Inventors: Cuong Ly, Köln; Stefan Amann, Langenfeld; Jürgen Jung, Leverkusen; Dieter Rockser, Leichlingen, all of (DE)

(73) Assignee: Agfa-Gevaert Naamloze Vennootschap (BE)

( * ) Notice: Subject to any disclaimer, the term of this patent is extended or adjusted under 35 U.S.C. 154(b) by 0 days.

(21) Appl. No.: 09/425,591

(22) Filed: Oct. 22, 1999

(30) Foreign Application Priority Data

Oct. 30, 1998 (DE) ..... 198 50 073
Apr. 1, 1999 (DE) ..... 199 14 881

(51) Int. Cl.[7] ..... G03C 1/005; G03C 1/494

(52) U.S. Cl. ..... 430/567; 430/503; 430/553; 430/557; 430/558; 430/569; 430/607; 430/608; 430/599; 430/604; 430/605

(58) Field of Search ..... 430/503, 541, 430/543, 557, 558, 553, 567, 607, 608, 599, 604, 605, 569

(56) References Cited

U.S. PATENT DOCUMENTS

| | | |
|---|---|---|
| 4,830,954 | 5/1989 | Matejec . |
| 5,500,329 | 3/1996 | Kawai et al. . |
| 5,759,762 | 6/1998 | Budz et al. . |

FOREIGN PATENT DOCUMENTS

| | | |
|---|---|---|
| 0 350 046 | 1/1990 | (EP) . |
| 0 774 689 | 5/1997 | (EP) . |
| 1212142 | 11/1970 | (GB) . |

*Primary Examiner*—Geraldine Letscher
(74) *Attorney, Agent, or Firm*—Connolly, Bove, Lodge & Hutz LLP

(57) ABSTRACT

A negatively developing color photographic silver halide material having a support and at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler, at least 95 mol % of the silver halides of which consist of AgCl, and in which at least one silver halide emulsion layer exhibits solarization on analogue exposure, is distinguished on scanning exposure by elevated color density and on analogue exposure by contrast which is independent of exposure time.

14 Claims, 2 Drawing Sheets

COLOR PHOTOGRAPHIC SILVER HALIDE MATERIAL

This application is related to German Application No. 198 50 073.4 filed Oct. 30, 1998 and German Application No. 199 14 881.3 filed Apr. 1, 1999, which are incorporated by reference in its entirety for all useful purposes.

This invention relates to a negatively developing colour photographic silver halide material, at least 95 mol % of the silver halide emulsions of which consist of AgCl, and which material is distinguished on scanning exposure by elevated colour density and on analogue exposure by contrast which is independent of exposure time.

Photographic paper is used for outputting "digital prints" on scanning film recorders, in which the exposure unit exposes the image information onto the photographic material pixel by pixel, line by line with high intensity collimated light (typically from gas or diode lasers or comparable devices) and very short exposure times per pixel (in the nano- to microsecond range). During such operations, the problem of line blurring occurs, especially at elevated densities. On the image, this results in fuzzy reproduction of edges (for example of lettering) on the subject and is vividly described as "blooming", "bleeding", "fringe formation", "smudging", "fuzziness" etc. This restricts the usable density range of the photographic paper. Photographic materials for outputting "digital prints" of an elevated image quality on scanning film recorders with LEDs or lasers may thus exhibit only slight line blurring at elevated colour density (extinction).

Method for Measuring Line Blurring

A measurement method which permits the measurement of line blurring for reflective photographic material (photographic paper) is described below. This method is based on the description of the measurement of the analogous problem on a transparent photographic material (c.f. H. Frieser, *Photographischer Informationsaufzeichnung*, R. Oldenbourg Verlag, Munich (1975), pages 266 et seq.). In this method, blurring is determined on the basis of a macrodensitometric measurement. To this end, two subjects are exposed adjacent to each other with an identical stepwise intensity profile (RGB values) for the exposed structures:

1. a half-tone line screen with screen lines and spaces of the particular width $b_o$ [mm], which is referred to below as the "half-tone step wedge" and
2. homogeneously filled areas ("solid step wedge").

Figure 1:
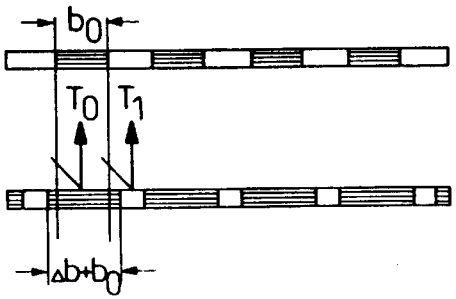

The status A densities $D_F$ of the steps are determined on the solid step wedge after a defined RGB exposure. The densities $D_R$ of a screen line pattern exposed with these same RGB values are determined on the half-tone step wedge. According to Frieser (op. cit.), an effective (microscopic) line widening $0<\Delta b<b_o$ may be determined on the basis of such a macrodensitometric measurement on screen line fields. This is determined by the proportions of the reflected intensity originating for each half-tone step from the screen lines themselves, i.e. $T_o$, and from the spaces, i.e. $T_l$ (c.f. FIG. 1).

The density of a half-tone step is calculated as follows:

$$D_R=-\log(T_R)=-\log(\tfrac{1}{2}\{T_1[1-{}^{\Delta b}/b_o]+T_o[1+{}^{\Delta b}/b_o]\}) \quad (1)$$

In an ideal photographic material without blurring, Δb would be equal to 0 and consequently:

$$D^*_R=-\log(\tfrac{1}{2}\{T_l+T_o\}) \quad (2)$$

Thus, since $10^{-Dmin}=T_l>T_o$, the constant density $0.3+D_{min}$ would be established asymptotically even at moderate screen line densities.

Figure 2:
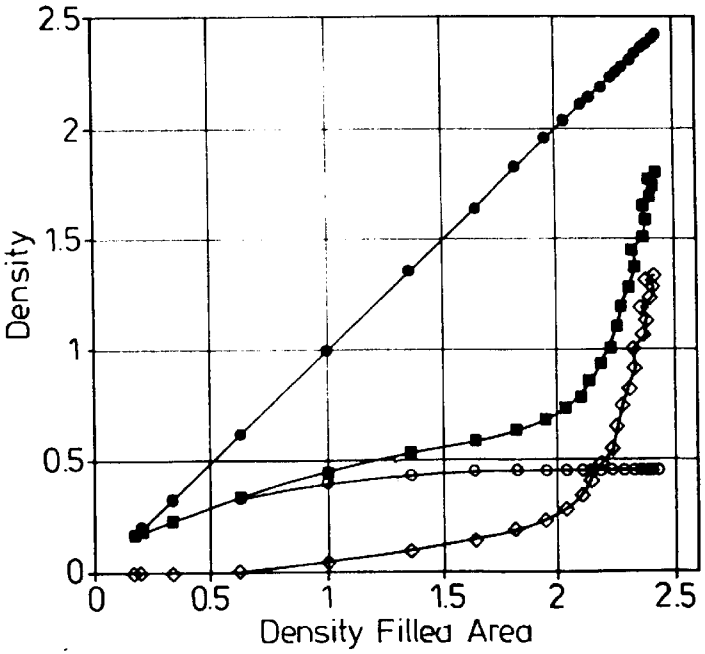
Figure 2:
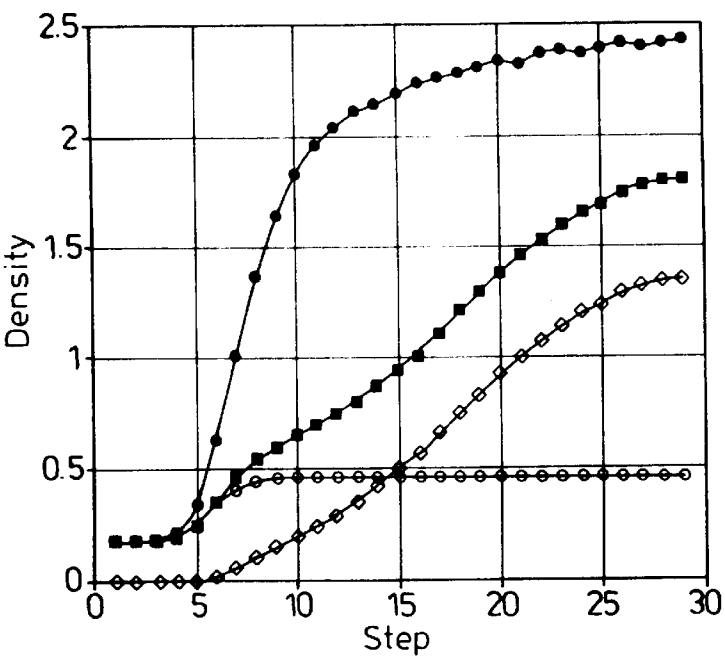

The difference between (1) and (2), the parameter $D_R-D^*_R$, thus constitutes for each step the difference in density due to line blurring (c.f. FIG. 2).

Where $T_l>T_o$, effective line widening may consequently be evaluated for each step $$\Delta b=b_o(1-10^{D^*R-DR}) \quad (3)$$

Figure 3:
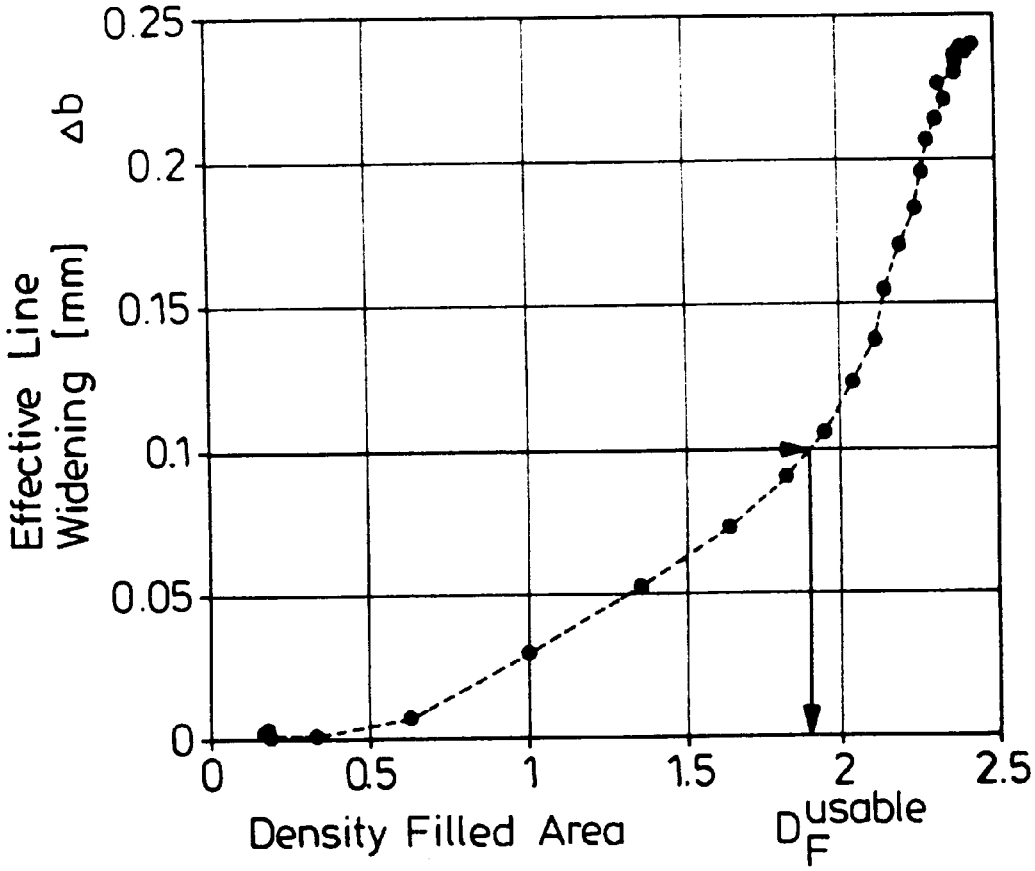

By stepwise plotting of (3) against the density of the corresponding solid field $D_F$, the usable maximum density $D_F^{usable}$ of a material may be determined directly (c.f. FIG. 3). Tolerable line widening values according to (3) were established by visual evaluation at Δb=0.10 mm for yellow (Y), magenta (M) and cyan (C).

Performance

Exposure

Exposure was performed using a conventional film recorder (model CSI Light Jet 2080 from Cymbolic Science, Vancouver (Canada)) with the following specification according to the manufacturer's data:

| Colour | Laser system | Wavelength | Maximum power | Beam diameter (FWHM) |
|---|---|---|---|---|
| Blue | argon ion | 458 nm | 150 μW | 25 μm |
| Green | helium-neon | 543 nm | 80 μW | 25 μm |
| Red | helium-neon | 633 nm | 2600 μW | 25 μm |

Paper: stationary on the inside of a half cylinder

Beam modulation: 8 bit acousto-optical modulator (AOM)

Beam mixing of blue, green and red in accordance with particular beam modulation Beam focussing by lenses x deflection (linewise "fast scan"): polygonal mirror rotating at 2000 rpm y deflection (slow scan): linear displacement of polygonal mirror along the cylinder axis Resolution 1016 dpi, exposure time per pixel: 400±100 ns Linear dot overlap approx. 30%

The recorder was operated in linear output mode for RGB (RGB=red, green, blue), i.e. without material-specific recorder calibration ("linearisation"). The maximum exposure power for the three colour channels is reduced with regard to the different material sensitivities for yellow, magenta and cyan in such a manner that, on the one hand, the maximum density of the material may be achieved and, on the other, when an identical RGP triplet is exposed (for example RGB=(100, 100, 100)), an at least approximately neutral subject is produced (blue: 6.5 μW; green: 10.4 μW; red: 680 μW).

In accordance with the condition $0<\Delta b<b_o$, a $b_o$ of 0.25 mm was selected for the screen line test image. This corresponds to a spatial frequency of 2 line pairs/mm. The lines of the screen are written in the fast scan direction, such that the effective, device-dependent blurring corresponds to the beam diameter. Due to the resolution of 1016 dpi (=spatial frequency of 20/mm) used, this device-dependent blurring may be disregarded in comparison with the blurring intrinsic to the material.

The test subject consists of a 29 step half-tone step wedge and a solid step wedge. The subject is produced by conventional software (for example Photoshop®), exposed onto a photographic paper with the scanning film recorder and the paper is then processed using AgfaColor process 94. Step 1 receives no exposure intensity (RGB=255) and thus produces $D_{min}$, step 29 (RGB=9) receives the maximum exposure intensity. Each pixel line was exposed in a single pass (disregarding the line overlap). Colour separations for the colours yellow, magenta and cyan and for neutral were exposed in a manner similar to that outlined for the neutral test subject by setting the complementary RGB channels to a constant 255 (without exposure). A step field is 20.0×6.35 mm in size.

The Figures show:

FIG. 1: Line width $b_o$ and effective line widening Δb by blurring

FIG. 2: Evaluation of increase in density due to line blurring; plot of density values against the step of the test subject (on the left) and against the density of the corresponding solid field (on the right)

measured density $D_F$ of solid field measured density $D_R$ of half-tone field with blurring theoretical density $D_R$* of ideal half-tone field without blurring increase in density $D_R$–$R_R$* due to line blurring FIG. 3: Determination of usable maximum density $D_F^{usable}$ from line widening Δb using the yellow density by way of example.

PRIOR ART AND OBJECT OF THE INVENTION

It is known from EP 774 689 that, in order to achieve a higher colour density in the case of pixel-by-pixel exposure with high intensity collimated light (typically from gas or diode lasers, LEDs or comparable devices) and very short exposure times per pixel (typically in the nano- to microsecond range), the gradation of the photosensitive layers of the colour negative paper used should be as steep as possible within the exposure time range.

One usual method of steepening the gradation of the photosensitive layers in colour negative papers is to increase the quantity of silver halide or colour coupler in the photosensitive layers. The disadvantages of this method are: increased material costs and impairment of processing stability (fluctuation in sensitometry depending upon process technology and due to processing variation within an operation), in particular at colour development times of less than 45 seconds. Due to the elevated contrast, such a material is not suitable for analogue exposure.

It is known from U.S. Pat. No. 5,759,762 that the doping of AgCl grains with complexes of the $(Me_2NH_2)_n$ $(AgCl_n)$ type in the presence of water-soluble disulfides, e.g. glutaramido phenyl disulphide, improves the stability of material when exposed to a laser beam.

It is furthermore known from EP 350 046 and U.S. Pat. No. 5,500,329 that gradation may be steepened in the exposure range of seconds or milliseconds by doping the silver halides with metal ions of group VIII or of transition metals of group II of the periodic system of elements. At shorter exposure times of the μsec to nanosec range, it has, however, been found that, despite doping, gradation flattens and sensitivity falls.

The object of the invention was to provide a material both for digital exposure, in particular laser exposure, and for integral exposure, which material is distinguished by elevated colour density on laser exposure and by contrast which is independent of exposure time on integral exposure.

This object is surprisingly achieved if the initially described colour photographic material contains at least one silver halide emulsion which exhibits solarisation on integral exposure.

Solarisation is taken to mean that the colour density decreases with increasing exposure intensity at constant exposure time or with a longer exposure time at constant exposure intensity (T. H. James, *The Theory of the Photographic Process*, pages 182–184; Macmillan Publishing Co. Inc., fourth edition).

The present invention accordingly provides a negatively developing colour photographic silver halide material, at least 95 mol % of the silver halide emulsions of which consist of AgCl, which material contains at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler, characterised in that at least one silver halide emulsion layer exhibits solarisation on integral exposure.

In a preferred embodiment the at least one silver halide emulsion layer which shows solarisation contains at least 0.1 mmol AgI/AgCl.

The silver halide emulsion of the silver halide emulsion layer exhibiting solarisation preferably contains silver halide grains comprising at least two differently precipitated zones.

This silver halide emulsion is preferably produced by preliminary precipitation and subsequent precipitation of a silver halide thereon, wherein this latter precipitation in particular proceeds by recrystallising a very fine grained silver halide emulsion (micrate emulsion) on the preliminary precipitate.

The preliminary precipitate is preferably a homodisperse, cubic silver halide emulsion containing at least 95 mol % AgCl and not more than 4 mol-% AgI. The micrate emulsion is preferably a homodisperse silver halide emulsion containing at least 90 mol % AgCl and at most 8 mol % AgI (remainder is AgBr) and having an average grain diameter (diameter of a sphere of identical volume) of 0.05 μm to 0.2 μm.

The finished silver halide emulsion is preferably homodisperse and cubic and contains silver halide grain containing at least 95 mol % AgCl and having an edge length of the cube of 0.20 μm to 2 μm.

The molar ratio of the outer zone to the remaining silver of the grain is in particular 1:24 to 6:1.

At least one zone of the stated silver halide emulsion is preferably doped with at least one kind of ions or metal complexes of the metals of groups VIII and IIB or of the metals Re, Au, Pb or Tl.

In the case of doping with more than one kind of ions or metal complexes of the metals of groups VIII and IIB or of the metals Re, Au, Pb or Tl, the ions or metal complexes may be added in a single zone or separately in two or more zones.

Preferred ions or metal complexes are: $Ir^{3+}$, $Ir^{4+}$, $Rh^{3+}$ and $Hg^{2+}$.

Quantity of $Ir^{3+}$, $Ir^{4+}$, $Rh^{3+}$: from 5 nmol/mol of Ag to 50 μmol/mol of Ag, preferably from 10 nmol/mol of Ag to 500 nmol/mol of Ag.

Quantity of $Hg^{2+}$: from 0.5 μmol/mol of Ag to 100 μmol/mol of Ag, preferably from 1 μmol/mol of Ag to 30 μmol/mol of Ag.

Mode of addition of $Ir^{3+}$, $Ir^{4+}$, $Rh^{3+}$ and $Hg^{2+}$: in NaCl feed solution.

Preferably, an inner zone, in particular the core, is doped with $Hg^{2+}$ and an outer zone, in particular the outermost zone, is doped with $Ir^{3+}$, $Ir^{4+}$ and/or $Rh^{3+}$.

The preferred amount of AgI in the preferred embodiment of the invention is 0.01 to 20 mmol/mol AgCl, particularly 0.1 to 5 mmol/mol AgCl.

The different doping of core and shell of a silver halide emulsion, in which the halide composition of the core and shell is identical or at least very similar, may be determined in the following manner:

1st method

The silver halide grains are fractionally dissolved with suitable silver halide solvent, for example a dilute aqueous thiosulfate solution. The nature and quantity of the doping metal or metals in the solutions is determined by ICP-MS.

2nd method

Direct methods not involving dissolution of the silver halide grains which may be considered are secondary-ion mass spectrometry (SIMS) and sputtered neutral mass spectrometry (SNMS).

Combined methods are also conceivable.

Recrystallisation is performed with NaCl solution or a bisthioether.

The bisthioethers are of the formula (I)

(I)

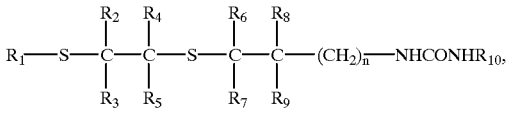

in which $R_1$ means an alkyl, alkenyl, cycloalkyl, aryl or aralkyl residue having no more than 8 C atoms or —C($R_6$, $R_7$)—C($R_8$, $R_9$)—$(CH_2)_n$NHCONH$R_{10}$, $R_2$ to $R_9$ mean H or alkyl having no more than 3 C atoms or, in pairs, the members of a five- or six-membered ring, $R_{10}$ means hydrogen or a substituent and n means 0 or 1.

Among compounds of the formula (I), those of the formula (II) are preferred (II)

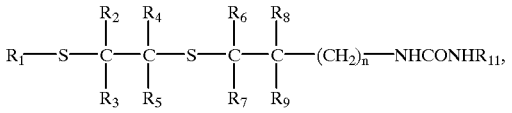

in which $R_1$ to $R_9$ and n have the above-stated meaning and $R_{11}$ means H, an alkyl, alkenyl or cycloalkyl group having no more than 6 C atoms, an acyl, alkoxycarbonyl, carbamoyl or sulfonyl group.

Suitable compounds of the formulae (I) or (II) are

I-1

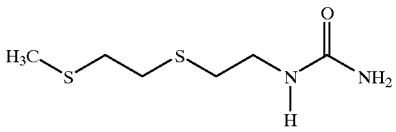

I-2

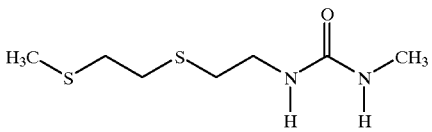

-continued

I-3

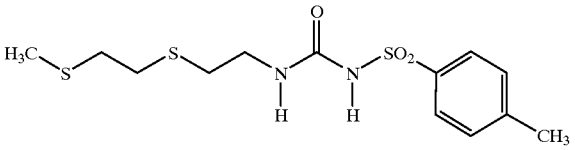

I-4

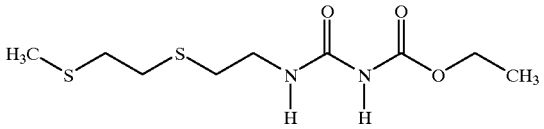

I-5

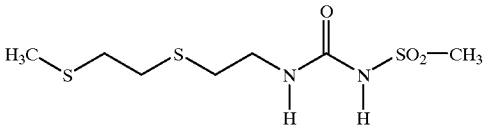

I-6

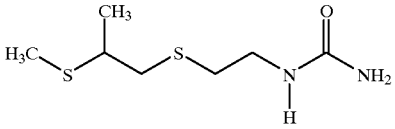

I-7

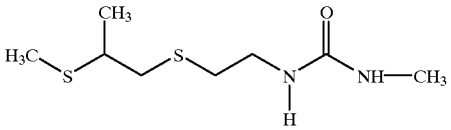

I-8

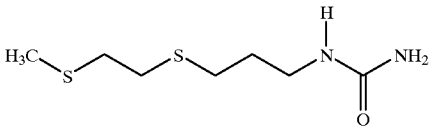

I-9

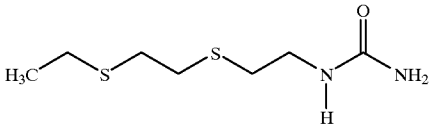

I-10

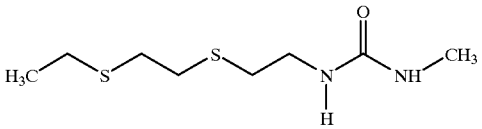

I-11

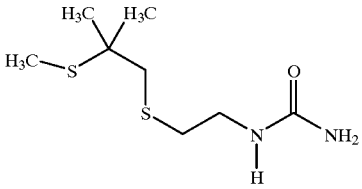

-continued

I-12

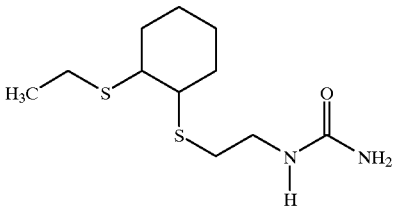

I-13

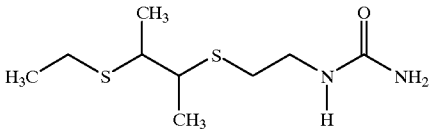

I-14

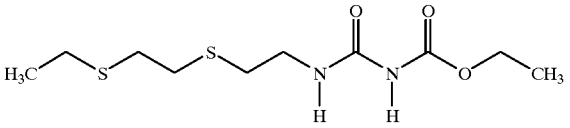

I-15

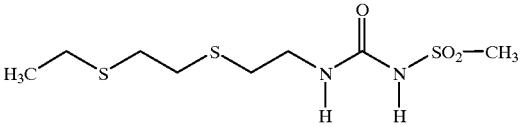

I-16

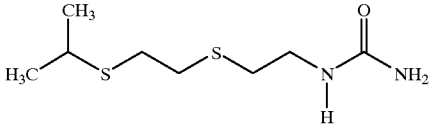

I-17

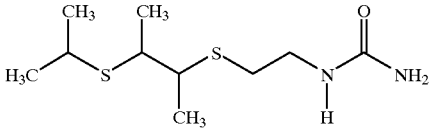

I-18

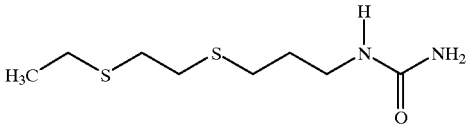

I-19

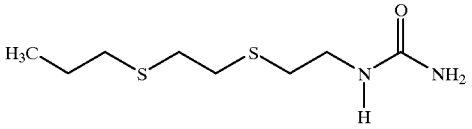

I-20

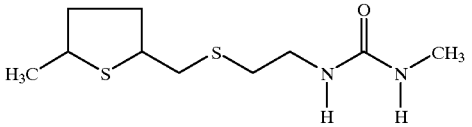

I-21

$C_2H_5—S—CH_2—CH_2—S—CH_2—CH_2—NHCO—(CH_2)_2—COOH.$

The colour photographic material is preferably a print material.

Photographic print materials consist of a support, onto which is applied at least one silver halide emulsion layer. Suitable supports are in particular thin films and sheets, as well as paper coated with polyethylene or polyethylene terephthalate. A review of support materials and the auxiliary layers applied to the front and reverse sides of which is given in *Research Disclosure* 37254, part 1 (1995), page 285.

Colour photographic print materials conventionally have, on the support, in the stated sequence one blue-sensitive, yellow-coupling silver halide emulsion layer, one green-sensitive, magenta-coupling silver halide emulsion layer and one red-sensitive, cyan-coupling silver halide emulsion layer; the layers may be interchanged.

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Precipitation may also proceed in the presence of sensitising dyes. Complexing agents and/or dyes may be rendered inactive at any desired time, for example by changing the pH value or by oxidative treatment.

Details relating to colour couplers may be found in *Research Disclosure* 37254, part 4 (1995), page 288 and in *Research Disclosure* 37038, part 11 (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Instant or rapid hardeners are preferably used, wherein instant or rapid hardeners are taken to be such compounds which crosslink the gelatine in such a manner that immediately after casting, at the latest a few days after casting, hardening is concluded to such an extent that there is no further change in the sensitometry and swelling of the layer structure determined by the crosslinking reaction. Swelling is taken to mean the difference between the wet layer thickness and dry layer thickness during aqueous processing of the material.

Suitable instant and rapid hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials. The colour photographic material according to the invention is in particular suitable for rapid processing with development times of 10 to 30 seconds.

Light sources which may be considered for exposure are in particular halogen lamps or laser film recorders.

Suitable magenta couplers are of the formulae III or IV (III)

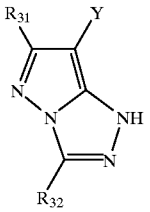

-continued (IV)

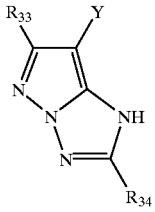

in which $R_{31}$, $R_{32}$, $R_{33}$ and $R_{34}$ mutually independently mean hydrogen, alkyl, aralkyl, aryl, aroxy, alkylthio, arylthio, amino, anilino, acylamino, cyano, alkoxycarbonyl, alkylcarbamoyl or alkylsulfamoyl, wherein these residues may be further substituted and wherein at least one of these residues contains a ballast group, and Y means a residue seperable during chromogenic development (fugitive group) other than hydrogen.

$R_{31}$ and $R_{33}$ are preferably tert.-butyl; Y is preferably chlorine.

These couplers are per se particularly advantageous thanks to the colour brightness of the magenta dyes produced therewith.

Preferred couplers of the formula III are those of the following formula

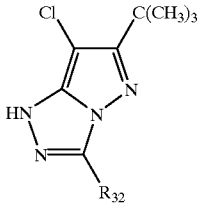

| Coupler | $R_{32}$ |
|---|---|
| III-1 | $—C_{13}H_{27}$ |
| III-2 | $—(CH_2)_3SO_2C_{12}H_{25}$ |
| III-3 | 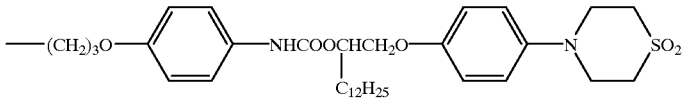 |
| III-4 | 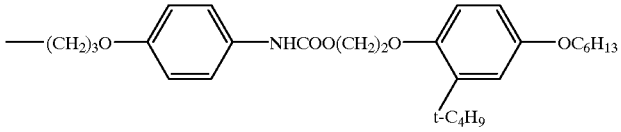 |
| III-5 | 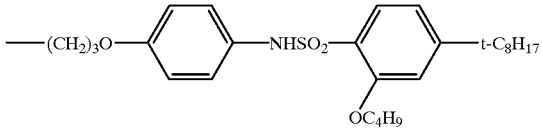 |

-continued
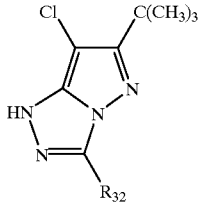
| Coupler | $R_{32}$ |
|---|---|
| III-6 | 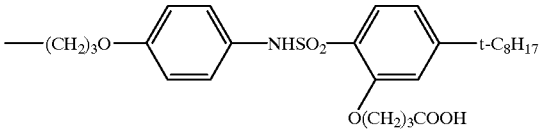 |
| III-7 | $—(CH_2)_2NHCOC_{13}H_{27}$ |
| III-8 | 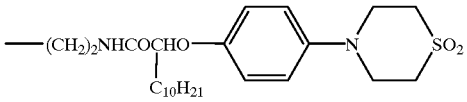 |
| III-9 | 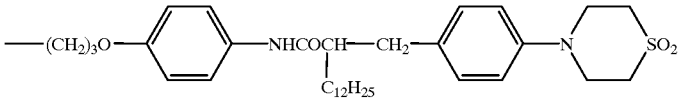 |
| III-10 | 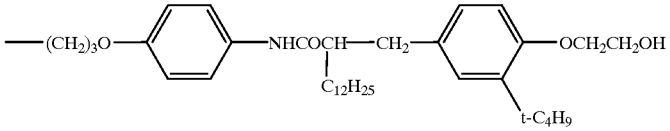 |
| III-11 | 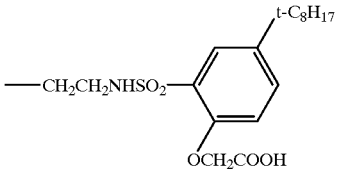 |
| III-12 | $—CH_2CH_2NHSO_2C_{16}H_{33}$ |
| III-13 | $—CH_2CH_2NHCONHC_{12}H_{25}$ |
| III-14 | $—(CH_2)_3NHSO_2C_{12}H_{25}$ |
| III-15 | 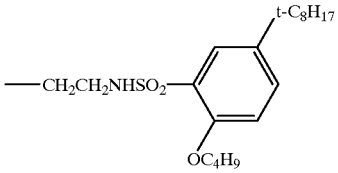 |
| III-16 | 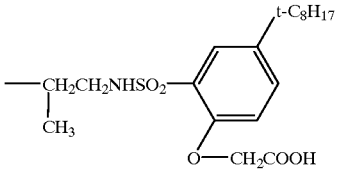 |

-continued
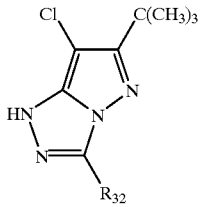
| Coupler | $R_{32}$ |
|---|---|
| III-17 | 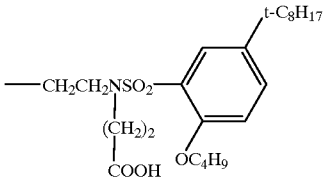 |
| III-18 | 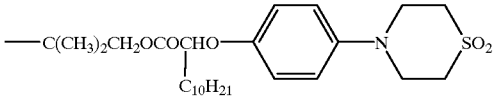 |
| III-19 | 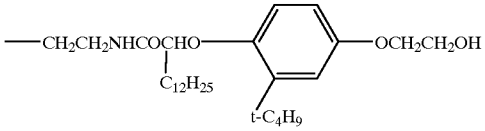 |
| III-20 | 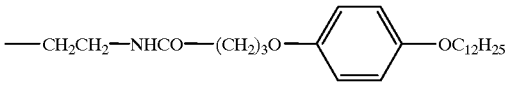 |
| III-21 as well as | $—CH_2CH_2NHCOOC_{12}H_{25}$ |
| III-22 | 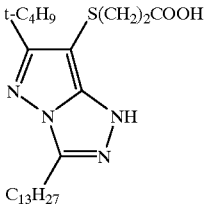 |
| III-23 | 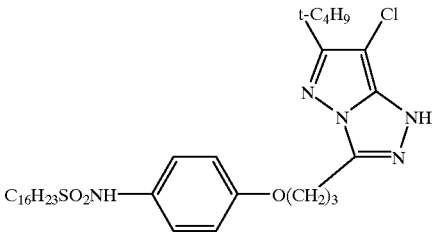 |

-continued
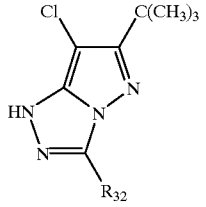
| Coupler | $R_{32}$ |
|---|---|
| III-24 | 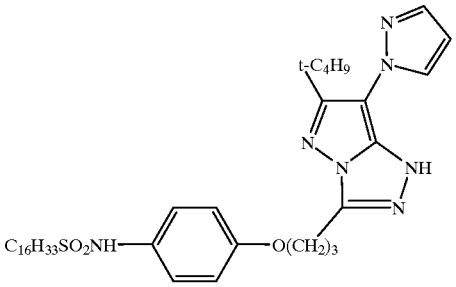 |
| III-25 | 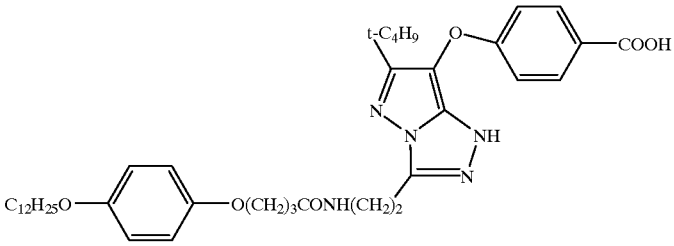 |
Suitable couplers of the formula IV are couplers of the following formula:
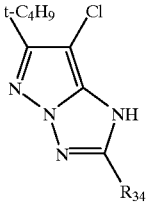
| Coupler | $R_{34}$ |
|---|---|
| IV-1 | 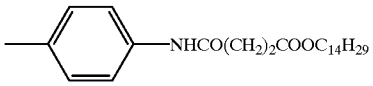 |
| IV-2 | 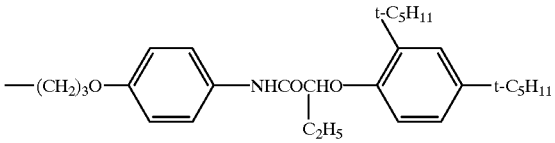 |

-continued
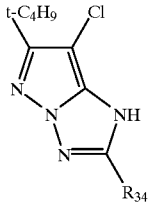
| Coupler | $R_{34}$ |
|---|---|
| IV-3 | 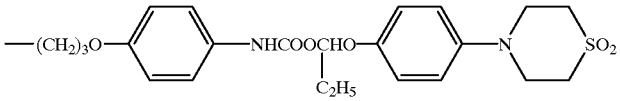 |
| IV-4 | 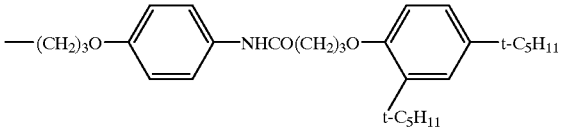 |
| IV-5 | 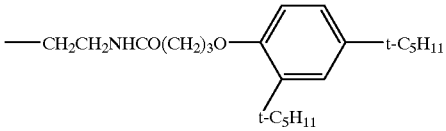 |
| IV-6 | 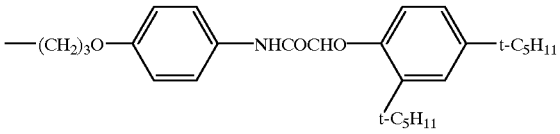 |
| IV-7 | 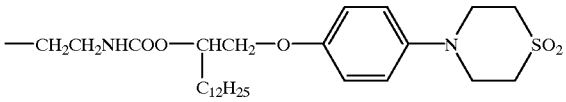 |
| IV-8 | 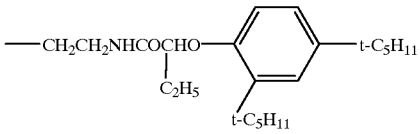 |
| IV-9 | $—CH_2CH_2NHCOC_{13}H_{27}$ |
| IV-10 | 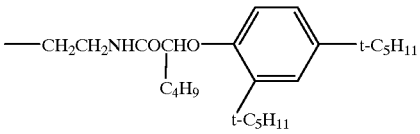 |
| IV-11 | $—(CH_2)_3SO_2C_{12}H_{25}$ |
| IV-12 | 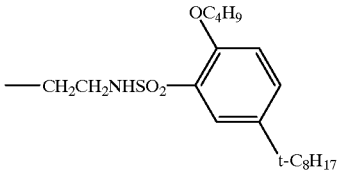 |

-continued
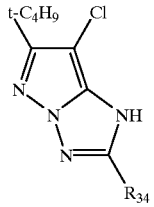
| Coupler | $R_{34}$ |
|---|---|
| IV-13 | 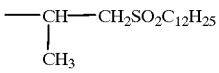 |
| IV-14 | 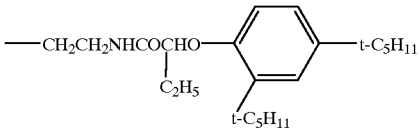 |
| IV-15 | 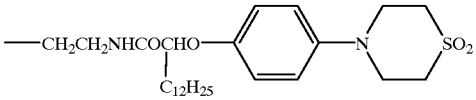 |
| IV-16 | 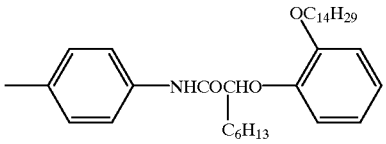 |
| IV-17 | 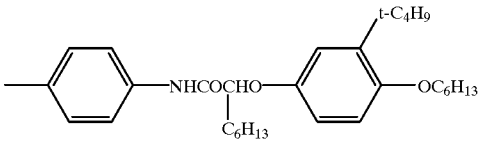 |
as well as
IV-18
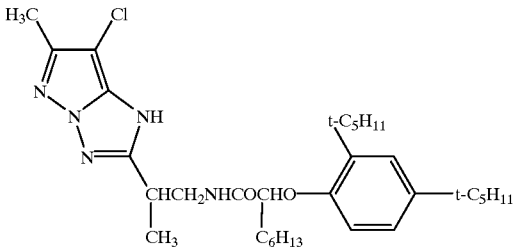
IV-19
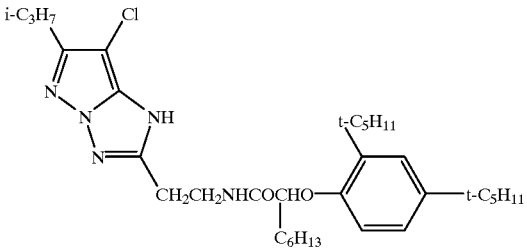

-continued
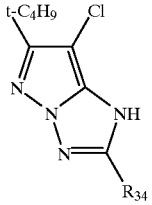
| Coupler | $R_{34}$ |
|---|---|
| IV-20 | 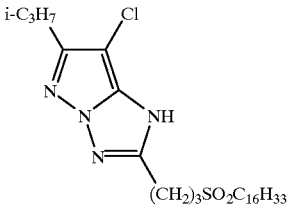 |
| IV-21 | 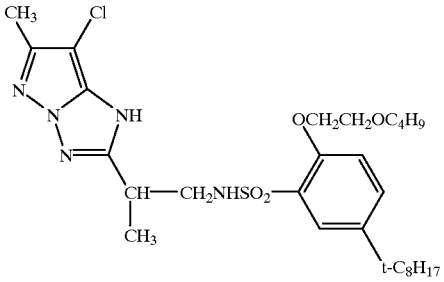 |
| IV-22 | 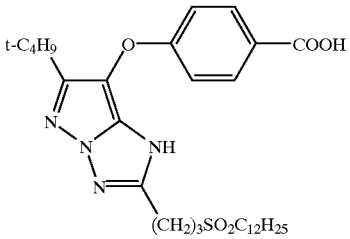 |
| IV-23 | 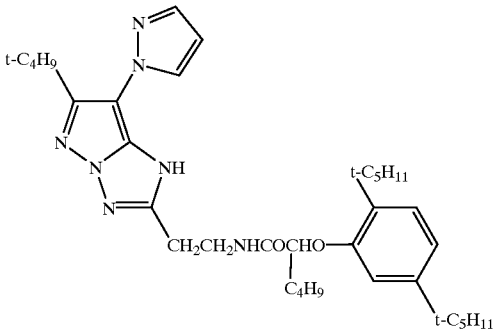 |

-continued

| Coupler | $R_{34}$ |
|---|---|
| | 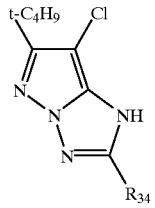 |
| IV-24 | 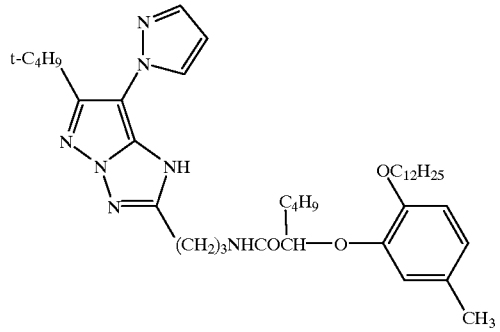 |

Suitable yellow couplers are of the fomula V

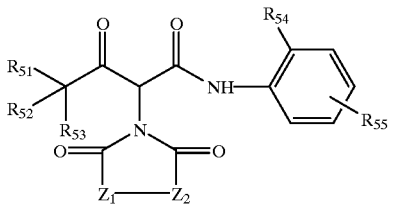

(V)

in which $R_{51}$, $R_{52}$, $R_{53}$ mutually independently mean alkyl or $R_{52}$ and $R_{53}$ together form a three- to six-membered ring;

$R_{54}$ means alkyl, alkoxy or halogen, $R_{55}$ means halogen, alkyl, alkoxy, aryloxy, alkoxycarbonyl, alkylsulfonyl, alkylcarbamoyl, arylcarbamoyl, alkylsulfamoyl, arylsulfamoyl;

$Z_1$ means —O—, —$NR_{56}$—;

$Z_2$ means —$NR_{57}$— or —$C(R_{58})R_{59}$—;

$R_{56}$, $R_{57}$, $R_{58}$ and $R_{59}$ mutually independently mean hydrogen or alkyl.

$R_{51}$, $R_{52}$ and $R_{53}$ are preferably $CH_3$.

$R_{54}$ is preferably Cl or $OCH_3$.

$R_{55}$ is preferably —$COOR_{60}$, —$CONHR_{60}$, —$SO_2NHCOR_{60}$, wherein $R_{60}$ is $C_{10}$–$C_{18}$ alkyl.

Examples of yellow couplers according to the invention of the formula (V) are:

V-1

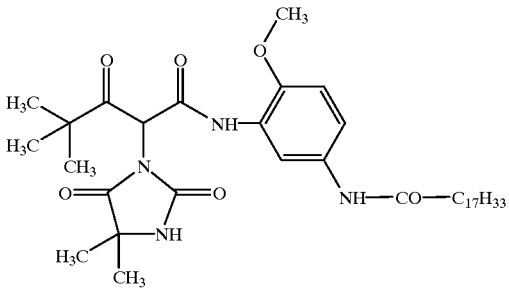

V-2

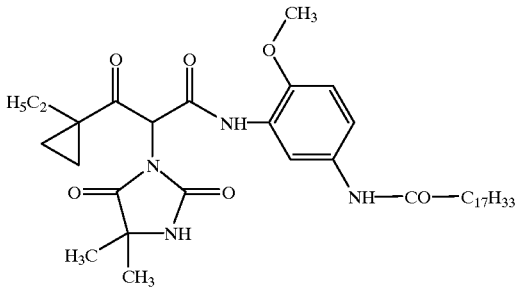

-continued
V-3
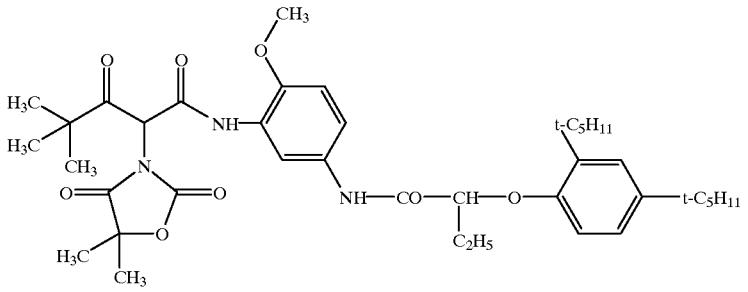
V-4
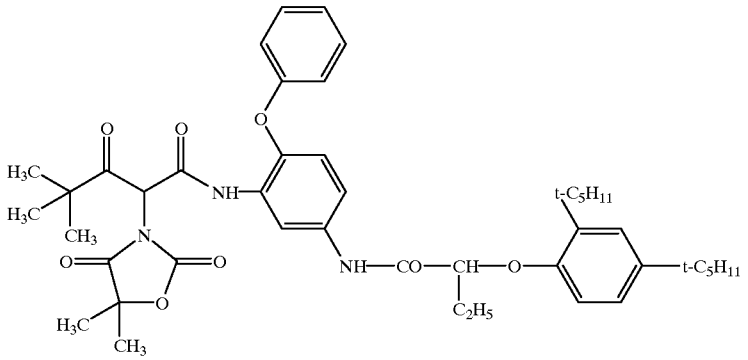
V-5
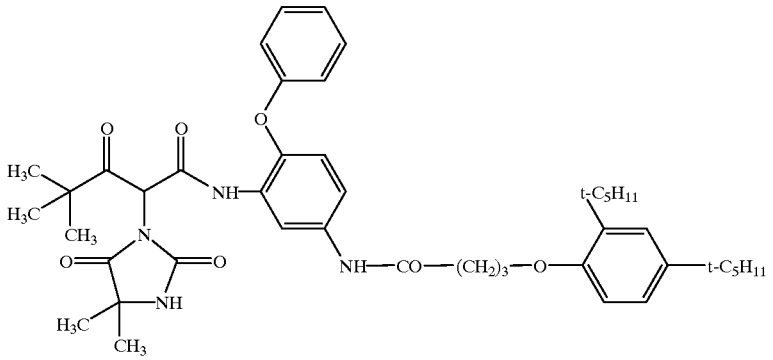
V-6
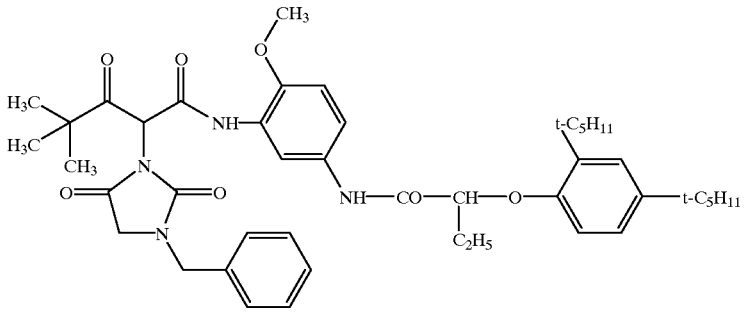

-continued
V-7
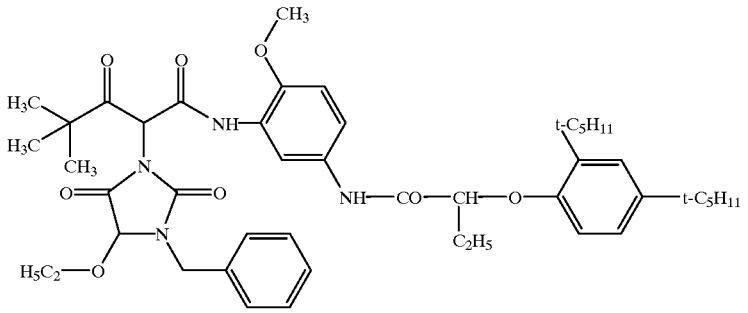
V-8
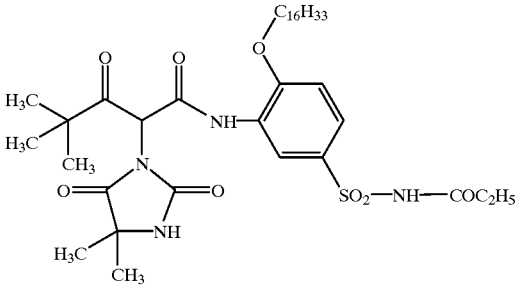
V-9
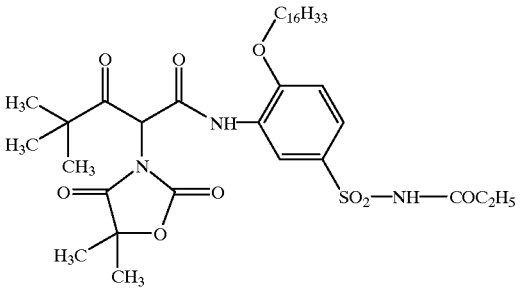
V-10
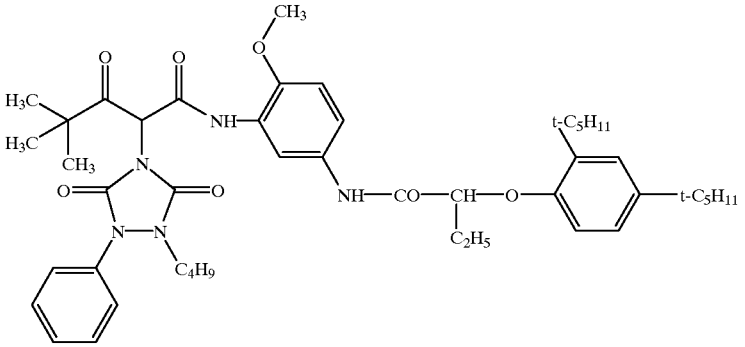

-continued
V-11
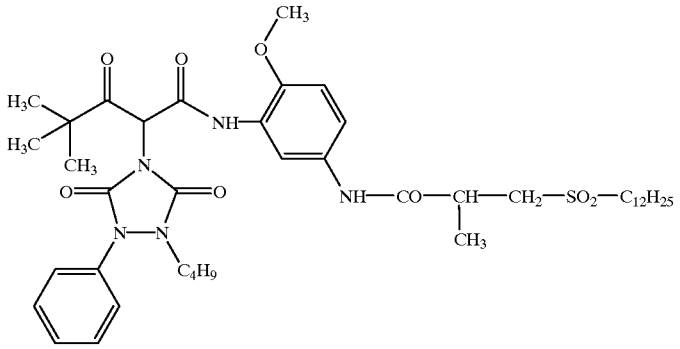
V-12
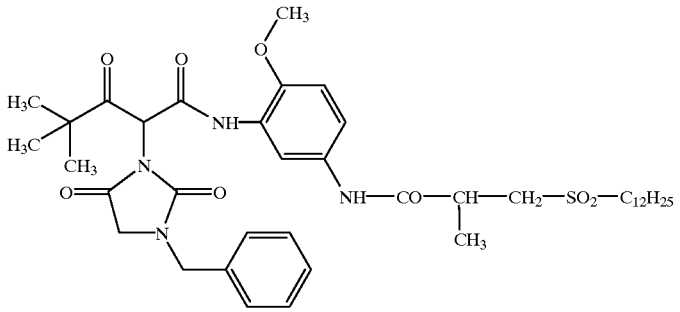
V-13
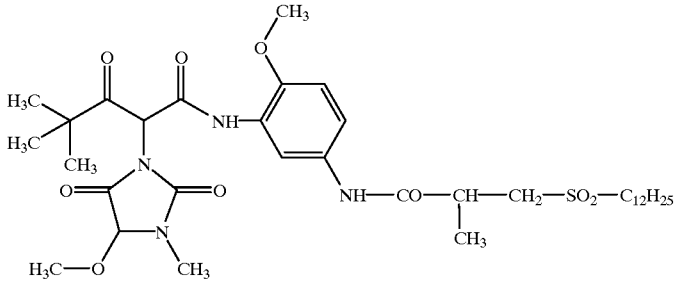
V-14
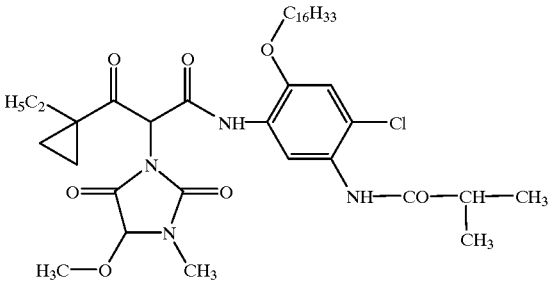
V-15
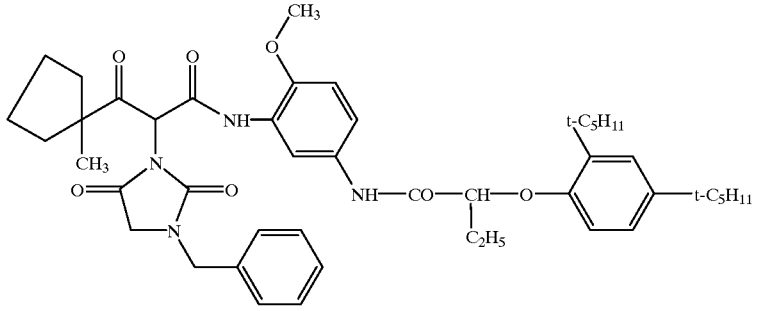

-continued
V-16
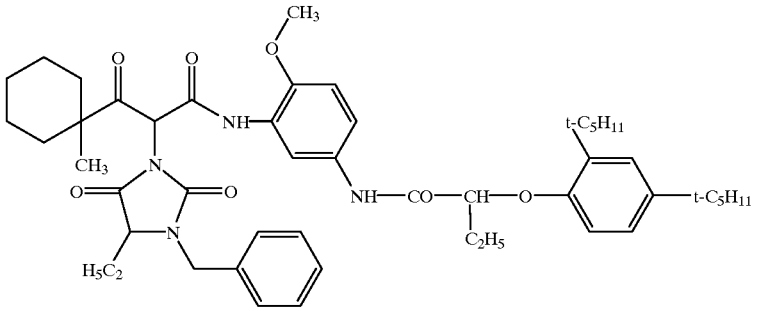
V-17
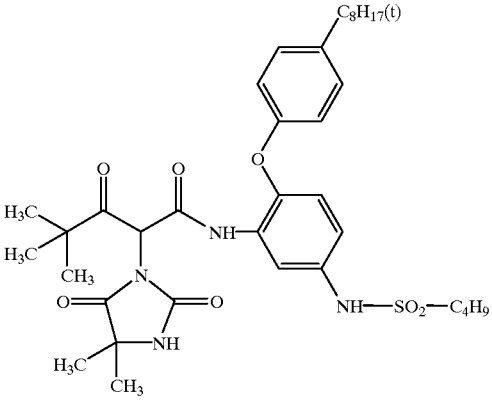
V-18
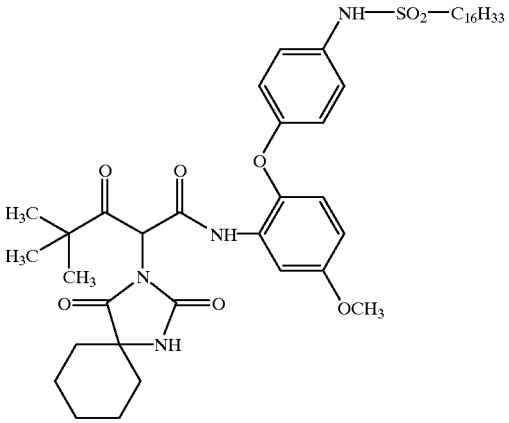
V-19
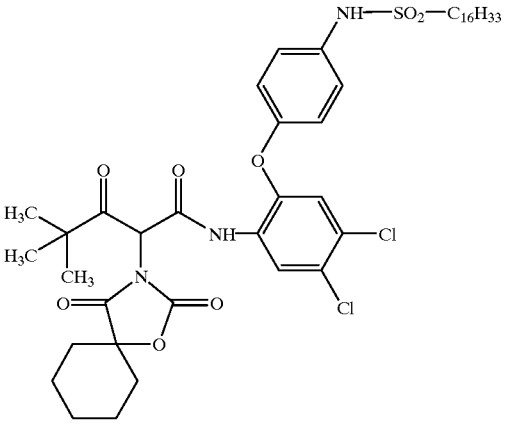
V-20
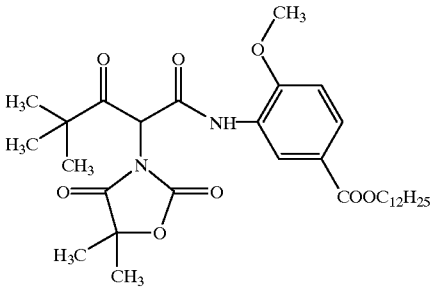
V-21
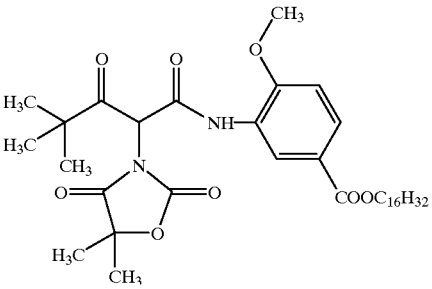
V-22
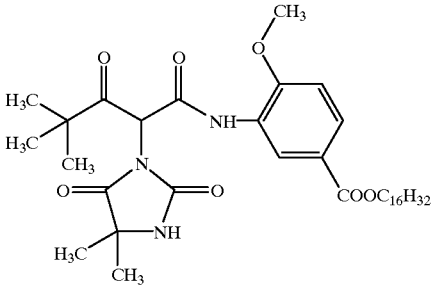

-continued
V-23
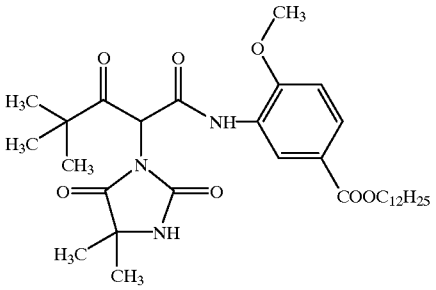
V-24
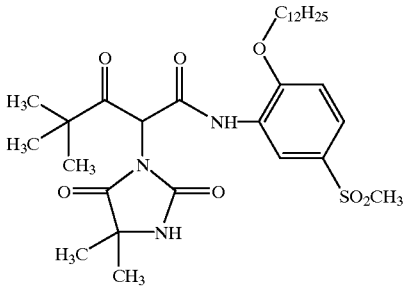
V-25
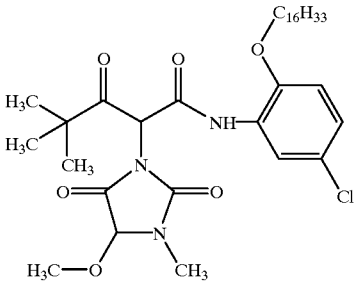
V-26
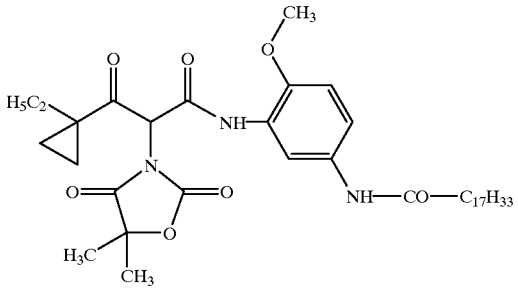
V-27
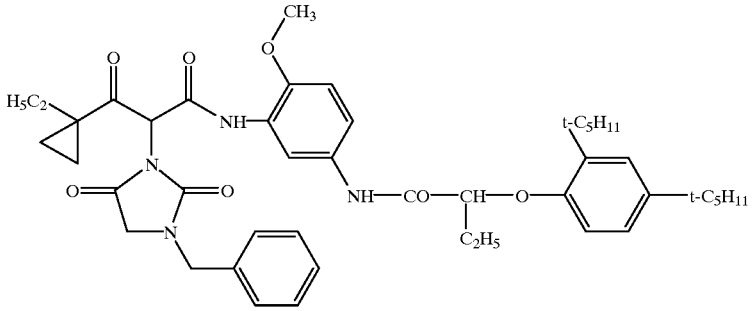
V-28
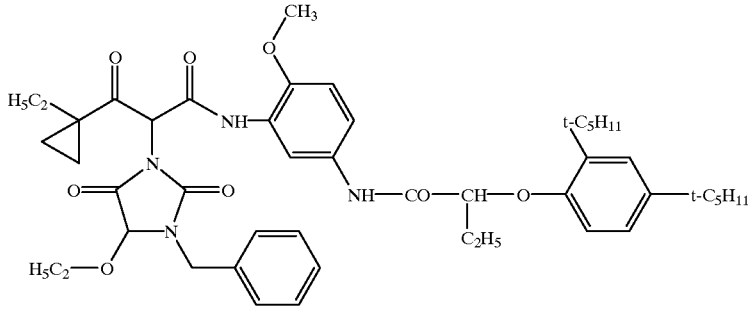
V-29
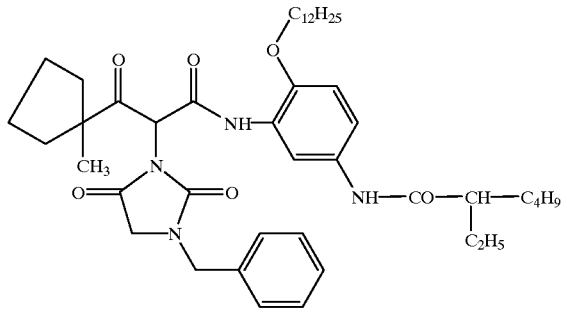

-continued
V-30
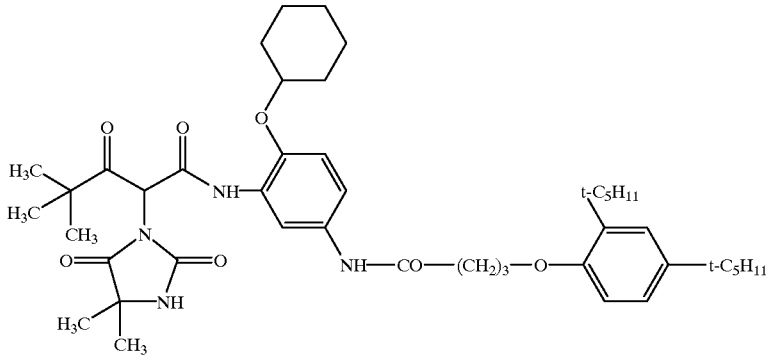
V-31
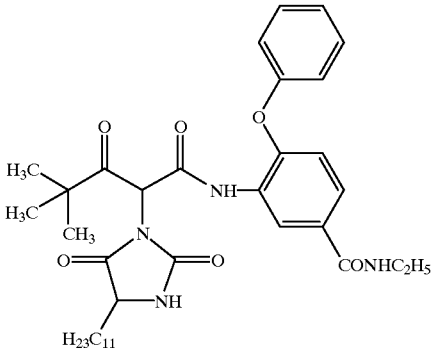
V-32
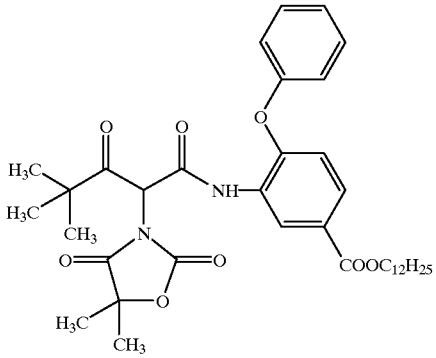
V-33
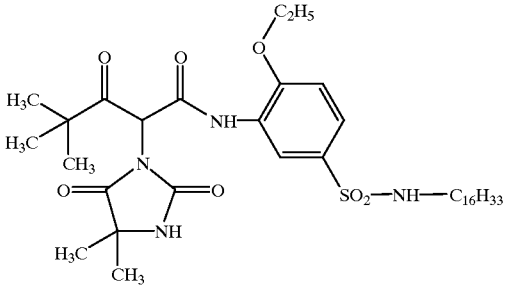
V-34
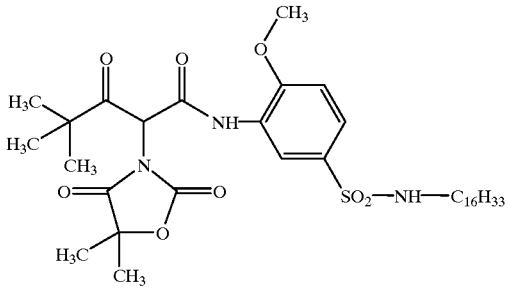
V-35
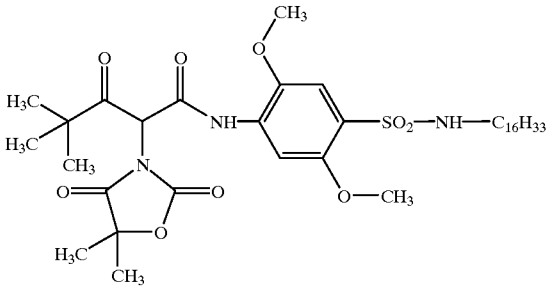

-continued
V-36
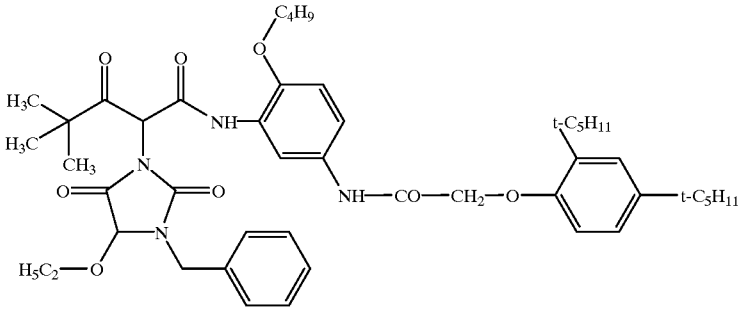
V-37
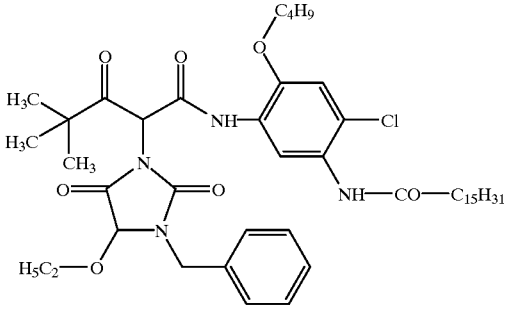
V-38
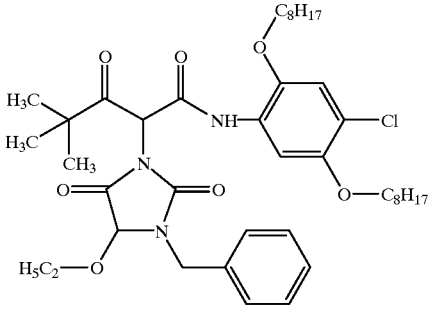
V-39
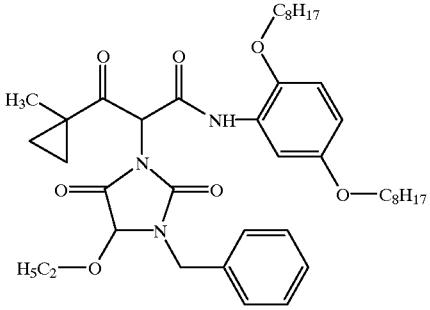
V-40
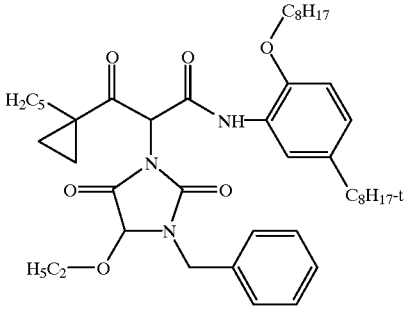
V-41
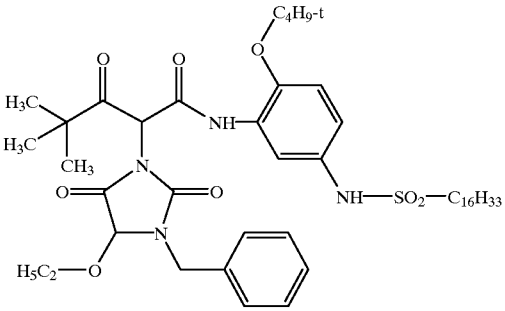
V-42
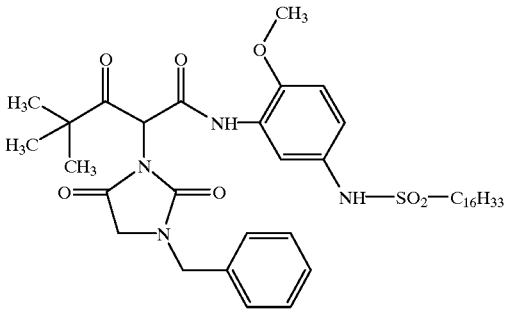
V-43
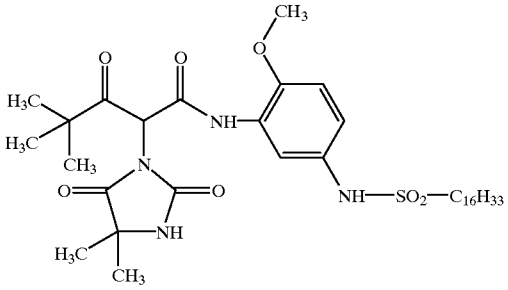
V-44
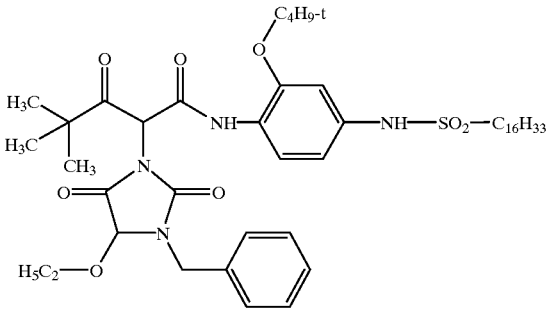

-continued
V-45
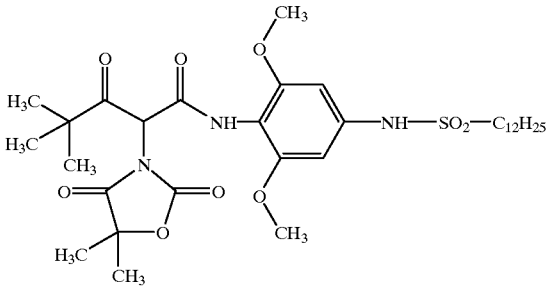
V-46
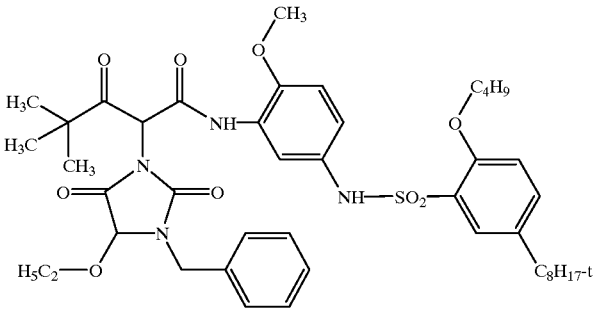
V-47
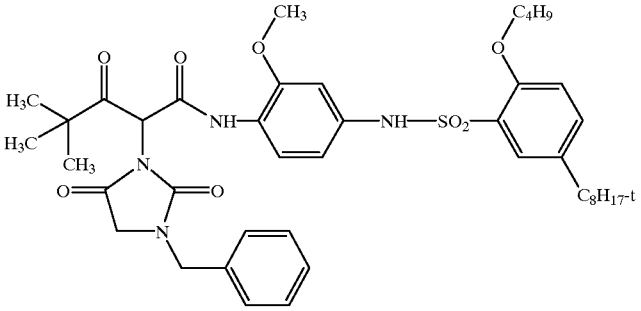
V-48
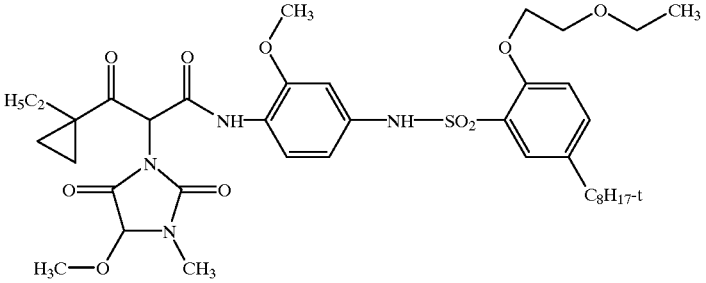
V-49
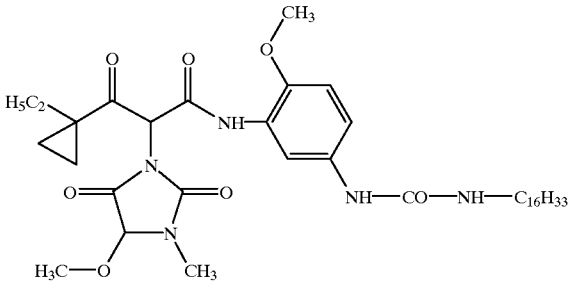

-continued

V-50

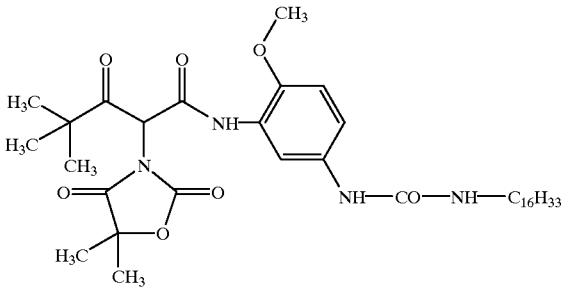

V-51

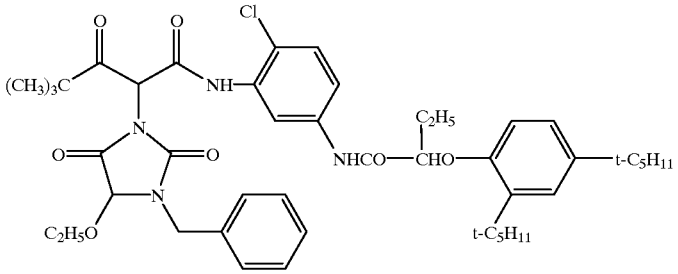

V-52

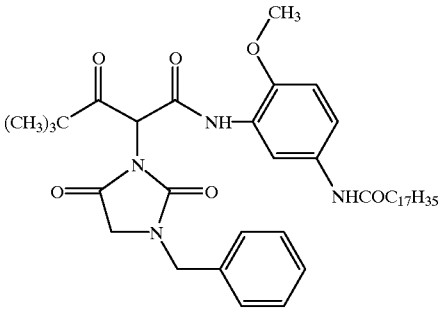

V-53

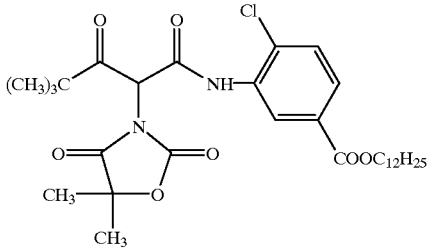

V-54

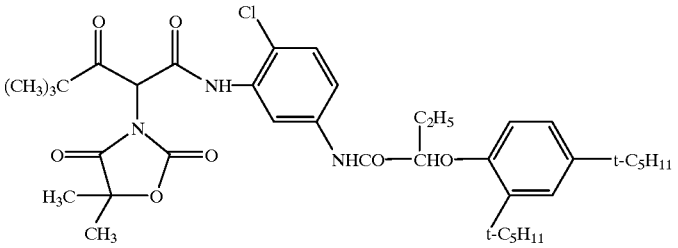

Suitable cyan couplers are of the formulae VI, VII, VIIa and VIII (VI)

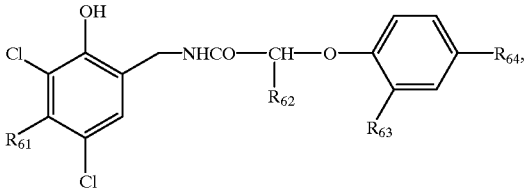

in which $R_{61}$, $R_{62}$, $R_{63}$ and $R_{64}$ mutually independently mean hydrogen or $C_1$–$C_6$ alkyl;

(VII)

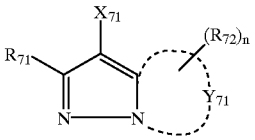

in which $R_{71}$ and $R_{72}$ mutually independently mean an electron withdrawing group, $X_{71}$ means H or a residue separable during chromogenic development, $Y_{71}$ means a group for the completion of an nitrogen containing heterocycle with the proviso that $R_{72}$ is linked to a carbon atom of said heterocycle, and n means a number 1 or 2;

(VIIa)

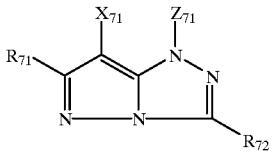

in which $R_{71}$, $R_{72}$ and $X_{71}$ have the above mentioned meaning and $Z_{71}$ means H or a substituent;

(VIII)

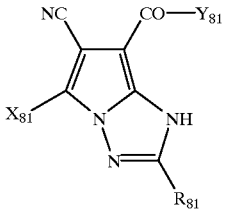

in which $R_{81}$ means H or a substituent, $X_{81}$ means H or a residue separable during chromogenic development, $Y_{81}$ means $OR_{82}$ or

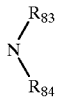

$R_{82}$ means

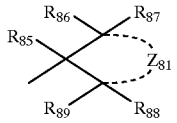

or alkyl, $R_{83}$ means alkyl, $R_{84}$ means H or $R_{83}$, $R_{85}$, $R_{86}$, $R_{88}$ and $R_{89}$ means H or a substituent, $R_{87}$ means a substituent and $Z_{81}$ means a group for the completion of a 3- to 8-membered ring, which may be substituted.

$R_{61}$ is preferably $CH_3$ or $C_2H_5$.

$R_{62}$ is preferably $C_2$–$C_6$ alkyl.

$R_{63}$ and $R_{64}$ are preferably t-$C_4H_9$ or t-$C_5H_{11}$.

Examples of cyan couplers of the formula VI are:

VI-1 with $R_{61}$=$C_2H_5$, $R_{62}$=n-$C_4H_9$, $R_{63}$=$R_{64}$=t-$C_4H_9$,

VI-2 with $R_{61}$=$R_{62}$=$C_2H_5$, $R_{63}$=$R_{64}$=t-$C_5H_{11}$,

VI-3 with $R_{61}$=$C_2H_5$, $R_{62}$=n-$C_3H_7$, $R_{63}$=$R_{64}$=t-$C_5H_{11}$, VI-4 with $R_{61}$=$CH_3$, $R_{62}$=$C_2H_4$, $R_{63}$=$R_{64}$=t-$C_5H_{11}$.

Examples for cyan couplers of formula VIIa are:

| | $R_{71}$ | $R_{72}$ | $X_{71}$ | $Z_{71}$ |
|---|---|---|---|---|
| VII-1 | 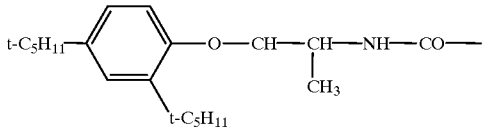 | 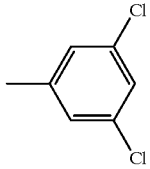 | H | H |
| VII-2 | 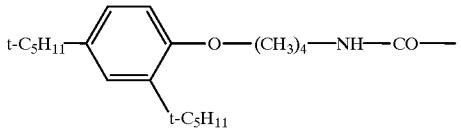 | 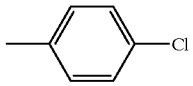 | —S—$CH_2$—$CH_2$—COOH | H |
| VII-3 | 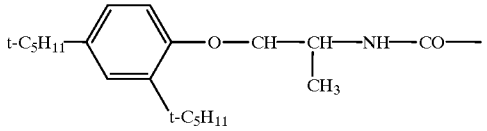 | 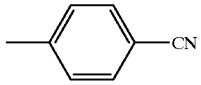 | Cl | H |
| VII-4 | 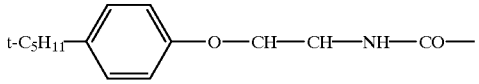 | 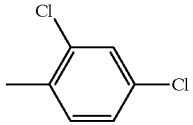 | H | H |
| VII-5 | 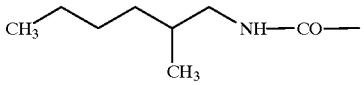 | 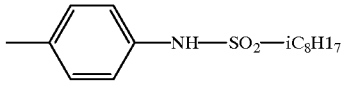 | 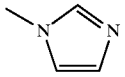 | H |
| VII-6 | $C_{16}H_{33}$—O—CO—$CH_2$—$CH_2$—NH—CO— | 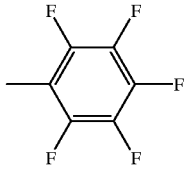 | H | H |

-continued
| | $R_{71}$ | $R_{72}$ | $X_{71}$ | $Z_{71}$ |
|---|---|---|---|---|
| VII-7 | $C_{12}H_{25}$—$SO_2$—$C_3H_6$—NH—CO— | —$CF_3$ | 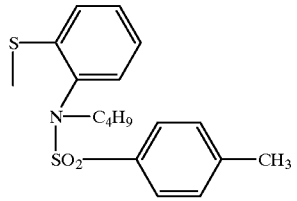 | H |
| VII-8 | 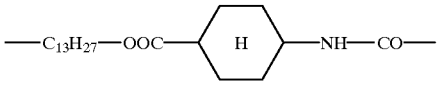 | 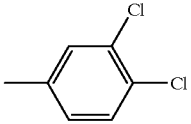 | H | H |
| VII-9 | 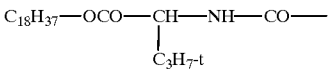 | 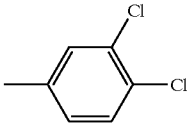 | H | H |
| VII-10 | $C_{18}H_{37}$—NH—$SO_2$ | 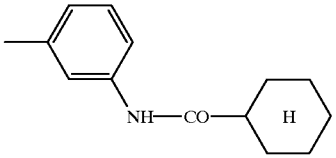 | H | H |
| VII-11 | 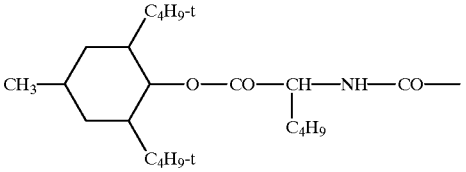 | CN | H | H |

-continued
| | $R_{71}$ | $R_{72}$ | $X_{71}$ | $Z_{71}$ |
|---|---|---|---|---|
| VII-12 | 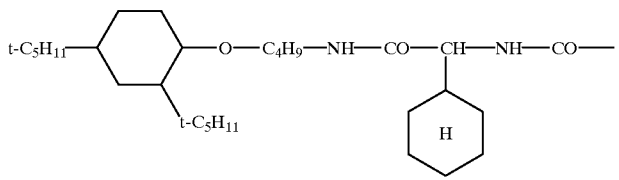 | 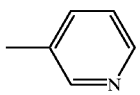 | H | H |
| VII-13 | 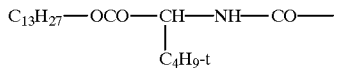 | 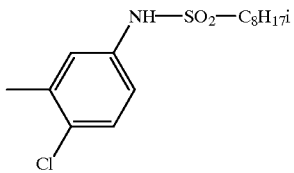 | 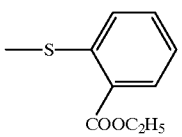 | H |
| VII-14 | 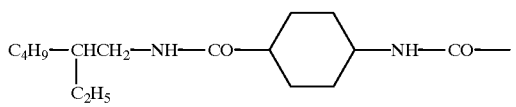 | 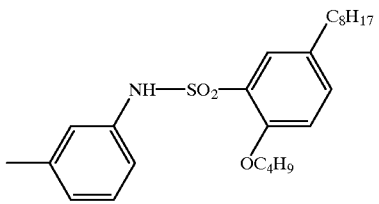 | H | H |
| VII-15 | $t\text{-}C_4H_9\text{—NH—CO—}$ | Copolymer aus 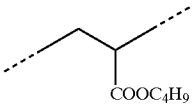 und 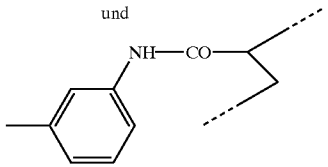 50/50 Gew.-% | H | H |

-continued
| | $R_{71}$ | $R_{72}$ | $X_{71}$ | $Z_{71}$ |
|---|---|---|---|---|
| VII-16 | —CN | 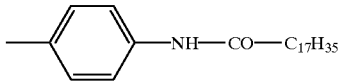 | —S—$CH_2$—$CH_2$—COOH | H |
| VII-17 | 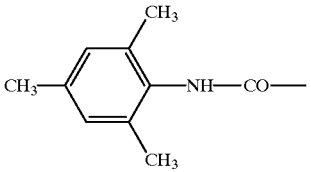 | 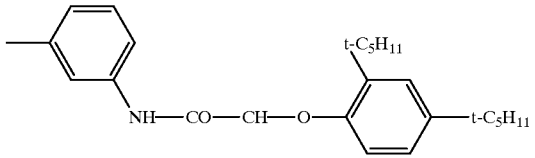 | H | H |
| VII-18 | 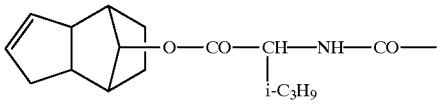 | 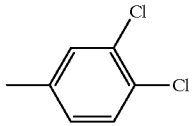 | H | H |
| VII-19 | $H_{33}C_{16}$—O—CO—CH(—$C_4H_9$)—NH—CO— | 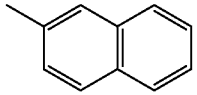 | H | H |
| VII-20 | $H_{27}C_{13}$—O—CO— 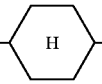 —NH—CO— | 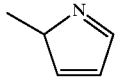 | H | H |

Examples of cyan couplers of formula VIII are:
| Nr. | $R_{81}$ | $X_{81}$ | $Y_{81}$ |
|---|---|---|---|
| VIII-1 | 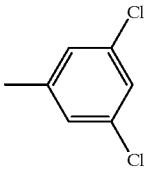 | H | 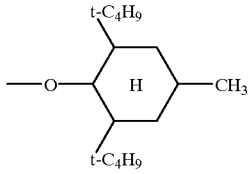 |
| VIII-2 | 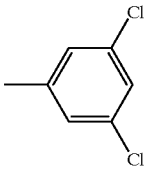 | 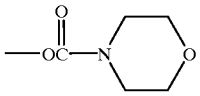 | 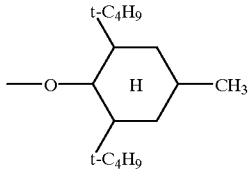 |
| VIII-3 | $t\text{-}C_4H_9$ | 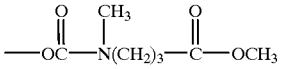 | 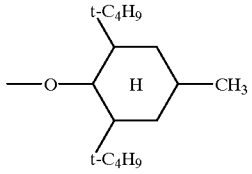 |
| VIII-4 | 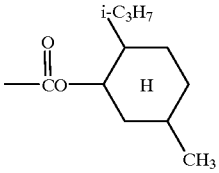 | 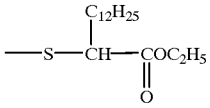 | 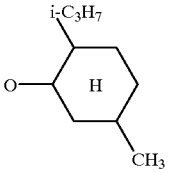 |
| VIII-5 | 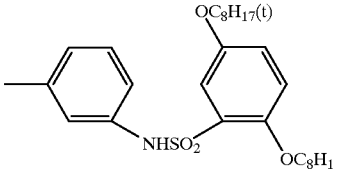 | H | 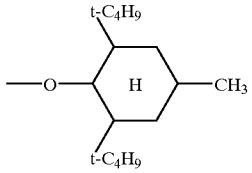 |
| VIII-6 | 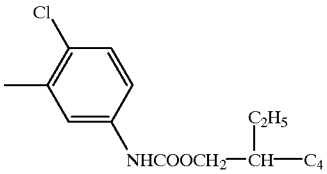 | H | 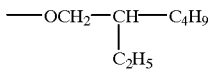 |
| VIII-7 | 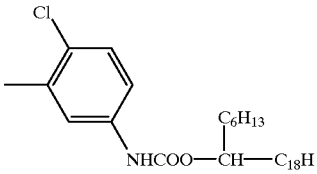 | H | 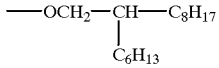 |

Production of the Silver Halide Emulsions

0. Micrate Emulsion (EmM1) (undoped micrates)

The following solutions are prepared using demineralised water:

| | | |
|---|---|---|
| Solution 01 | 5500 g | water |
| | 700 g | gelatine |
| | 5 g | n-decanol |
| | 20 g | NaCl |
| Solution 02 | 9300 g | water |
| | 1800 g | NaCl |
| Solution 03 | 9000 g | water |
| | 5000 g | $AgNO_3$ |

Solutions 02 and 03 are added simultaneously at 50° C. over the course of 30 minutes at a pAg of 7.7 and a pH of 5.0 with vigorous stirring to solution 01. During precipitation, the pAg value is held constant by apportioning an NaCl solution and the pH value by apportioning $H_2SO_4$ to the precipitating tank. An AgCl emulsion having an average particle diameter of 0.09 μm is obtained. The gelatine/$AgNO_3$ weight ratio is 0.14. The emulsion is ultrafiltered at 40° C., washed and redispersed in a quantity of gelatine and water such that the gelatine/$AgNO_3$ weight ratio is 0.3 and the emulsion contains 200 g of AgCl per kg. After redispersion, the grain size is 0.12 μm.

Production of Micrate Emulsion EmM2:

As for EmM1,except that 570 μg of $K_2IrCl_6$ are additionally added to solution 02. The emulsion contains 20 nmol of $Ir^{4+}$ per mol of AgCl.

Production of Micrate Emulsion EmM3:

As for EmM2, except that the quantity of $K_2IrCl_6$ in solution 02 is increased to 28.5 mg. The emulsion contains 1 mmol of $Ir^{4+}$ per mol of AgCl.

Production of Micrate Emulsion EmM4:

As for EmM1, except that 1140 μg of $K_2IrCl_6$ are additionally added to solution 02.

Production of Micrate Emulsion EmM5:

As for EmM2, except that in 20.4 g of KI are additionally added to solution 02.

Production of Micrate Emulsion EmM6:

As for EmM1, except that 1140 μg of $K_2IrCl_6$ and 20.4 g of KI are additionally added to solution 0.2.

1. Blue-sensitive Emulsions EmB1–EmB10

EmB1

The following solutions are prepared using demineralised water:

| | | |
|---|---|---|
| Solution 11 | 1100 g | water |
| | 136 g | gelatine |
| | 1 g | n-decanol |
| | 4 g | NaCl |
| | 65 g | EmM1 |
| Solution 12 | 1860 g | water |
| | 360 g | NaCl |
| | 57 μg | $K_2IrCl_6$ |
| Solution 13 | 1800 g | water |
| | 1000 g | $AgNO_3$ |

Solutions 12 and 13 are added simultaneously at 50° C. over the course of 150 minutes at a pAg of 7.7 with vigorous stirring to solution 11, which had initially been introduced into the precipitating tank. The pAg and pH values are controlled as in the case of the precipitation of emulsion (EmM1). Feed is controlled in such a manner that over the first 100 minutes, the feed rate of solution 13 rises linearly from 2 ml/min to 18 ml/min and a constant feed rate of 20 ml/min is used for the remaining 50 minutes. An AgCl emulsion having an average particle diameter of 0.71 μm is obtained. The emulsion contains 10 nmol of $Ir^{4+}$ per mol of AgCl. The gelatine/$AgNO_3$ weight ratio (the quantity of AgCl in the emulsion is hereinafter converted to $AgNO_3$) is 0.14. The emulsion is ultrafiltered, washed and redispersed in a quantity of gelatine and water such that the gelatine/$AgNO_3$ weight ratio is 0.56 and the emulsion contains 200 g of $AgNO_3$ per kg.

The emulsion is ripened for 2 hours at a temperature of 50° C. with an optimum quantity of gold(III) chloride and $Na_2S_2O_3$ at a pH of 0.53. After chemical ripening, the emulsion is spectrally sensitised at 40° C. with 30 mmol of compound (Sens B), stabilised with 0.4 mmol of compound (Stab-1) and then combined with 0.006 mol of KBr, these quantities each being stated per mol of AgCl.

SensB:

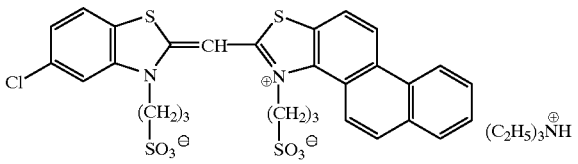

Stab-1:

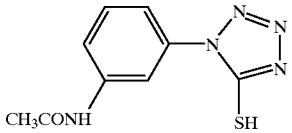

EmB2

Precipitation, removal of salts, redispersion, chemical ripening, spectral sensitisation and stabilisation are performed as for EmB1, except that 100 mg of bisthioether I-9 are added to solution 11 before the beginning of precipitation.

EmB3

As for EmB2, except that:

1. before the beginning of precipitation, the solution 11 initially introduced into the precipitating tank does not contain compound I-9 and solution 12 does not contain $K_2IrCl_6$.
2. 100 mg of compound I-9 are not added to the precipitating tank and 57 μg of $K_2IrCl_6$ are not added to solution 12 until 10 minutes after 50% of solution 13 have been apportioned.

Removal of salts and redispersion are performed as for EmB1. Grain size after redispersion is 0.72 μm. The outermost zone differs from the inner zones in that it contains 20 nmol of $Ir^{4+}$ per mol of AgCl and that reduction nuclei are produced by compound I-9. Chemical ripening, spectral sensitisation and stabilisation are performed as for EmB1.

EmB4

The emulsion is produced by recrystallising the micrate emulsion EmM2 onto a preliminary precipitate EmV1.

Production of Preliminary Precipitate EmV1: (undoped preliminary precipitate)

As for EmB1, except that:

1. solution 12 contains no $K_2IrCl_6$.
2. the quantity of additions to solution 11 is doubled.
3. the feed rate of solution 13 rises linearly from 4 ml/min to 36 ml/min, such that precipitation is complete within 100 minutes. An AgCl emulsion having an average particle diameter of 0.56 μm is obtained. The gelatine/

$AgNO_3$ weight ratio is 0.144. The emulsion is ultrafiltered, washed and redispersed with a quantity of gelatine such that the gelatine/$AgNO_3$ weight ratio is 0.56.

Production of EmB4:

2.5 kg of preliminary precipitate EmV1 (corresponds to 500 g of $AgNO_3$) are initially introduced into a precipitating tank and melted at 40° C. 2.5 kg of EmM2 (corresponds to 500 g of $AgNO_3$) are initially introduced into a feed tank equipped with a stirrer and melted at 40° C. While preliminary precipitate EmV1 is being vigorously stirred, 100 mg of compound I-9 are added. After 5 minutes, micrate emulsion EmM2 is apportioned at a constant rate within 50 minutes. After 10 minutes, the emulsion is redispersed with a quantity of gelatine such that the gelatine/$AgNO_3$ weight ratio is 0.56. An AgCl emulsion having an average particle diameter of 0.72 μm is obtained. Chemical ripening, spectral sensitisation and stabilisation are performed as for EmB1.

EmB5

The emulsion is produced as for EmB4, but, before micrate emulsion EmM2 is recrystallised onto preliminary precipitate EmV1, 100 ml of 20 wt. % aqueous NaCl solution are added instead of compound I-9.An AgCl emulsion having an average particle diameter of 0.70 μm is obtained. Chemical ripening, spectral sensitisation and stabilisation are performed as for EmB1.

EmB6

The emulsion was produced as for EmB4, except that:

1. the preliminary precipitate contains 114 mg of $K_2IrCl_6$ (=20 nmol of $K_2IrCl_6$ per mol of Ag).
2. the micrate emulsion used for the recrystallisation is EmM1 instead of EmM2.

The emulsion contains 20 nmol of $Ir^{4+}$. Compound I-9 produces reduction nuclei in the core and shell.

EmB7

The emulsion is produced as for EmB1, but 1.02 g of KI is additionally added to solution 12. The average particle diameter is 0.72 μm.

EmB8

The emulsion is produced as for EmB7, but $K_2IrCl_6$, KI and compound I-9 are not added until 75% of solution 13 have been apportioned. The average particle diameter is 0.72 μm.

EmB9

The emulsion is produced as for EmB8 but the contents of solutions 12 and 13 are rearranged in solutions 22 to 25.

| | |
|---|---|
| solution 22 | 1395 g of water |
| | 270 g of NaCl |
| | 1,02 g of KI |
| | 57 μg of $K_2IrCl_6$ |
| solution 23 | 1350 g of water |
| | 750 g of $AgNO_3$ |
| solution 24 | 465 g of water |
| | 90 g of NaCl |
| solution 25 | 450 g of water |
| | 250 g of $AgNO_3$ |

The first feed is performed with the solution 22 and 23. The second feed is performed with solutions 24 and 25. 10 minutes before the second feed 100 mg of compound I-9 are added to the precipitating tank. The average particle diameter is 0.72 μm.

EmB10

The emulsion is produced as for EmB8, but the $K_2IrCl_2$ in solution 12 is omitted. The average particle diameter is 0.71 μm.

Blue-sensitive Emulsions EmB11–EmB18

These emulsions are produced by recrystallising micrate emulsions onto a preliminary precipitate.

Production:

Production of Preliminary Precipitates EmV2–EmV6:

EmV2

As for EmB1, except that:

1. solution 12 contains no $K_2IrCl_6$,
2. the quantity of additions to solution 11 is enhanced by 35%,
3. the feed rate of solution 13 rises linearly from 4 ml/mm to 36 ml/min, such that precipitation is complete within 100 minutes. An AgCl emulsion having an average particle diameter of 0.64 μm is obtained. The gelatine/$AgNO_3$ weigh t ratio is 0.144. The emulsion is ultrafiltered, washed and redispersed with a quantity of gelatine such that the gelatine/$AgNO_3$ weight ratio is 0.56.

EmV3

As for EmV2, except that 1.36 g of KI are added to solution 12.

EmV4

As for EmV2, except that 76 μg of $K_2IrCl_6$ are added to solution 12.

EmV5

As for EmV2, except that 76 μg of $K_2IrCl_6$ and 1.36 g of KI are added to solution 12.

EmV6

As for EmV2, except that 760 μg of $K_2IrCl_6$ and 13.6 g of KI are added to solution 12.

Production of Emulsion EmB11

900 g of preliminary precipitate EmV2 (corresponds to 180 g of $AgNO_3$) are initially introduced into a precipitating tank and melted at 40° C. 300 g of EmM1 (corresponds to 60 g of $AgNO_3$) are initially introduced into a feed tank equipped with a stirrer and melted at 40° C. While preliminary precipitate EmV2 is being vigorously stirred, 95 mg of compound I-9 are added. After 5 minutes, micrate emulsion EmM1 is apportioned at a constant rate within 20 minutes. After 10 minutes, the emulsion is redispersed with a quantity of gelatine such that the gelatine/$AgNO_3$ weight ratio is 0.56. An AgCl emulsion having an average particle diameter of 0.73 μm is obtained. Chemical ripening, spectral sensitisation and stabilisation are performed as for EmB1.

EmB12

As for EmB11 but with EmV3 instead of EmV2.

EmB13

As for EmB11 out with EmV5 instead of EmV2.

EmB14

As for EmB11 but with EmM5 instead of EmM1.

EmB15

As for EmB14 but with EmV4 instead of EmV2.

EmB16

As for EmB11 but with EmM6 instead of EmM1.

EmB17

As for EmB16 but with EmV4 instead of EmV2.

EmB18

As for EmB16 but with EmV5 instead of EmV2.

The following table shows the grain structure and doping of the sensitive emulsions $B_1$ and $B_7$ to $B_{18}$.

| emulsion | layer* | Production by | doping with $Ir^{4+}$ (nmol/Mol Ag) | doping with AgI (mmol/Mol Ag) | fraction of the layer on the total grain |
|---|---|---|---|---|---|
| B1 | 1 | EmM1 | 0 | 0 | 1,3% |
| | 2 | double jet | 10 | 0 | 98,7% |
| B7 | 1 | EmM1 | 0 | 0 | 1,3% |
| | 2 | double jet | 10 | 1 | 98,7% |
| B8 | 1 | EmM1 | 0 | 0 | 1,3% |
| | 2 | double jet | 0 | 0 | 74% |
| | 3 | double jet | 40 | 4 | 24,7% |
| B9 | 1 | EmM1 | 0 | 0 | 1,3% |
| | 2 | double jet | 13,3 | 1,33 | 74% |
| | 3 | double jet | 0 | 0 | 24,7% |
| B10 | 1 | EmM1 | 0 | 0 | 1,3% |
| | 2 | double jet | 0 | 0 | 74% |
| | 3 | double jet | 0 | 4 | 24,7% |
| B11 | 1 | EmM1 | 0 | 0 | 0,975% |
| | 2 | double jet | 0 | 0 | 74,025% |
| | 3 | recrystallisation | 0 | 0 | 25% |
| B12 | 1 | EmM1 | 0 | 0 | 0,975% |
| | 2 | double jet | 0 | 1,33 | 74,025% |
| | 3 | recrystallisation | 0 | 0 | 25% |
| B13 | 1 | EmM5 | 0 | 0 | 0,975% |
| | 2 | double jet | 13,3 | 1,33 | 74,025% |
| | 3 | recrystallisation | 0 | 4 | 25% |
| B14 | 1 | EmM5 | 0 | 0 | 0,975% |
| | 2 | double jet | 0 | 0 | 74,025% |
| | 3 | recrystallisation | 0 | 4 | 25% |
| B15 | 1 | EmM5 | 0 | 0 | 0,975% |
| | 2 | double jet | 13,3 | 0 | 74,025% |
| | 3 | recrystallisation | 0 | 4 | 25% |
| B16 | 1 | EmM6 | 0 | 0 | 0,975% |
| | 2 | double jet | 0 | 0 | 74,025% |
| | 3 | recrystallisation | 40 | 4 | 25% |
| B17 | 1 | EmM6 | 0 | 0 | 0,975% |
| | 2 | double jet | 13,3 | 0 | 74,025% |
| | 3 | recrystallisation | 40 | 4 | 25% |
| B18 | 1 | EmM6 | 0 | 0 | 0,975% |
| | 2 | double jet | 133 | 13,3 | 74,025% |
| | 3 | recrystallisation | 40 | 4 | 25% |

*The lowest number means the inner layer; the highest number means the outer layer 2. Green-sensitive Emulsions EmG1–EmG2

EmG1

The following solutions are prepared using demineralised water:

| | | |
|---|---|---|
| Solution 21 | 1100 g | water |
| | 136 g | gelatine |
| | 1 g | n-decanol |
| | 4 g | NaCl |
| | 186 g | EmM1 |
| Solution 22 | 1860 g | water |
| | 3600 g | NaCl |
| | 57 μg | $K_2IrCl_6$ |
| Solution 23 | 1800 g | water |
| | 1000 g | $AgNO_3$ |
| | 4.8 mg | $HgCl_2$ |

Solutions 22 and 23 are added simultaneously at 40° C. over the course of 75 minutes at a pAg of 7.7 with vigorous stirring to solution 21,which had initially been introduced into the precipitating tank. The pAg and pH values are controlled as in the case of the precipitation of emulsion EmM1. Feed is controlled in such a manner that over the first 50 minutes, the feed rate of solution 23 rises linearly from 4 ml/min to 36 ml/min and a constant feed rate of 40 ml/min is used for the remaining 25 minutes. An AgCl emulsion having an average particle diameter of 0.50 μm is obtained. The emulsion contains 10 nmol of $Ir^{4+}$ and 3 μmol of $HgCl_2$ per mol AgCl. The gelatine/$AgNO_3$ weight ratio is 0.14. The emulsion is ultrafiltered, washed and redispersed in a quantity of gelatine and water such that the gelatine/$AgNO_3$ weight ratio is 0.56 and the emulsion contains 200 g of $AgNO_3$ per kg.

2.5 kg of the emulsion (corresponds to 500 g of $AgNO_3$) are ripened for 2 hours at a temperature of 60° C. with an optimum quantity of gold(III) chloride and $Na_2S_2O_3$ at a pH of 0.53. After chemical ripening, the emulsion is spectrally sensitised at 50° C. with 40 mmol of compound (Sens G), stabilised with 0.4 mmol of compound (Stab-1) and 0.4 mmol of compound (Stab-2) and 0.4 mmol of compound (Stab-3) and then combined with 0.01 mol of KBr, these quantities each being stated per mol of AgCl.

SensG:

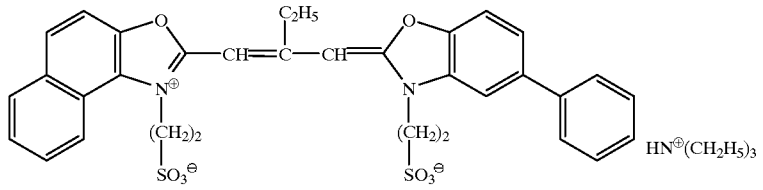

Stab-2:

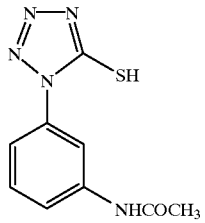

-continued

Stab-3:

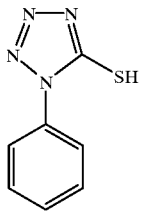

EmG2

2.5 kg of emulsion EmG1 (corresponds to 500 g of $AgNO_3$) are initially introduced into a precipitating tank and melted at 40° C. 250 g of EmM3 (corresponds to 50 g of $AgNO_3$) are initially introduced into a feed tank equipped with a stirrer and melted at 40° C. While emulsion EmG1 is being vigorously stirred, EmM3 is apportioned at a constant rate within 5 minutes. After 10 minutes, the emulsion is redispersed with a quantity of gelatine such that the gelatine/$AgNO_3$ weight ratio is 0.56.An AgCl emulsion having an average particle diameter of 0.52 $\mu$m is obtained. Chemical ripening, spectral sensitisation and stabilisation are performed as for EmG1.

Red-Sensitive Emulsion EmR1

Precipitation, removal of salts and redispersion are performed as for the green-sensitive emulsion EmG1. After chemical ripening with an optimum quantity of gold(III) chloride and $Na_2S_2O_3$ at a temperature of 60° C., the emulsion is spectrally sensitised at 40° C. with 50 $\mu$mol of compound (Sens R) and stabilised with 954 $\mu$mol of (Stab-2) and 2.24 mmol of (Stab-4), these quantities each being stated per mol of $AgNO_3$. 0.003 mol of KBr are then added.

SensR:

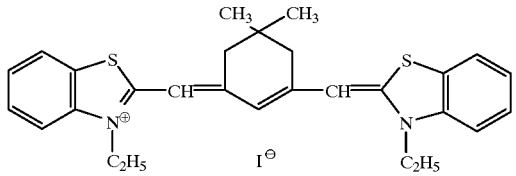

Stab-4:

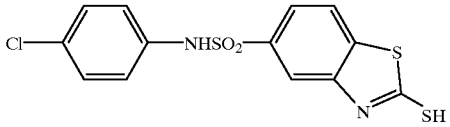

Table 1 shows the nature and quantity of the doping of the silver halide emulsions. The zones are numbered from the inside outwards.

TABLE 1

| Emulsion | No. of Doping zones | | Proportion of zone in grain |
|---|---|---|---|
| B-1 | 1 | 10 nmol $Ir^{4+}$/mol AgCl | 100% |
| B-2 | 1 | 10 nmol $Ir^{4+}$/mol AgCl | 100% |
| B-3 | 2 | Zone 1: - | 50% |
| | | Zone 2: 20 nmol $Ir^{4+}$/mol AgCl | 50% |
| B-4 | 2 | Zone 1: - | 50% |
| | | Zone 2: 20 nmol $Ir^{4+}$/mol AgCl | 50% |

TABLE 1-continued

| Emulsion | No. of Doping zones | | Proportion of zone in grain |
|---|---|---|---|
| B-5 | 2 | Zone 1: - | 50% |
| | | Zone 2: 20 nmol $Ir^{4+}$/mol AgCl | 50% |
| B-6 | 2 | Zone 1: 20 nmol $Ir^{4+}$/mol AgCl | 50% |
| | | Zone 2: - | 50% |
| G 1 | 1 | 10 nmol $Ir^{4+}$ & 3 $\mu$mol $Hg^{2+}$/mol AgCl | 100% |
| G 2 | 2 | Zone 1: 10 nmol $Ir^{4+}$ & 3 $\mu$mol $Hg^{2+}$/mol AgCl | 90.9% |
| | | Zone 2: 1000 nmol $Ir^{4+}$/mol AgCl | 9.1% |
| R 1 | 1 | 10 nmol $Ir^{4+}$ & 3 $\mu$mol $Hg^{2+}$/mol AgCl | 100% |

Layer Structures

A colour photographic recording material was produced by applying the following layers in the stated sequence onto a layer support of paper coated on both sides with polyethylene. All quantities are stated per 1 $m^2$. The silver halide application rate is stated as the corresponding quantities of $AgNO_3$.

Layer Structure 1

$1^{st}$ layer (Substrate layer):
- 0.3 g of gelatine $2^{nd}$ layer (Blue-sensitive layer):
- EmB1 prepared from 0.40 g of $AgNO_3$
- 0.635 g of gelatine
- 0.55 g of yellow coupler V-1
- 0.38 g of tricresyl phosphate (TCP)

$3^{rd}$ layer (Interlayer):
- 1.1 g of gelatine
- 0.08 g of scavenger SC
- 0.02 g of white coupler WK
- 0.1 of TCP $4^{th}$ layer (Green-sensitive layer):
- EmG1 prepared from 0.23 g of $AgNO_3$
- 1.2 g of gelatine
- 0.23 g of magenta coupler III-1
- 0.23 g of dye stabiliser ST-3
- 0.17 g of dye stabiliser ST-4
- 0.23 g of TCP $5^{th}$ layer (UV protective layer)
- 1.1 g of gelatine
- 0.08 g of SC
- 0.02 g of WK
- 0.6 g of UV absorber UV
- 0.1 of TCP $6^{th}$ layer (Red-sensitive layer):
- EmR-1 prepared from 0.26 g of $AgNO_3$ with
- 0.75 g of gelatine
- 0.40 g of cyan coupler VI-2
- 0.36 g of TCP $7^{th}$ layer (UV protective layer):

0.35 g of gelatine 0.15 g of UV 0.075 g of TCP $8^{th}$ layer (UV protective layer)

0.9 g of gelatine 0.3 g of hardener HM

Layer Structure 2 as layer structure 1, but the blue-sensitive emulsion in the $2^{nd}$ layer is EmB2 containing 0.4 g of $AgNO_3/m^2$.

Layer Structure 3 as layer structure 1, but the blue-sensitive emulsion in the $2^{nd}$ layer is EmB3 containing 0.4 g of $AgNO_3/m^2$.

Layer Structure 4 as layer structure 1, but the blue-sensitive emulsion in the $2^{nd}$ layer is EmB4 containing 0.4 g of $AgNO_3/m^2$.

Layer Structure 5 as layer structure 1, but the blue-sensitive emulsion in the $2^{nd}$ layer is EmB5 containing 0.4 g of $AgNO_3/m^2$.

Layer Structure 6 as layer structure 1, but the blue-sensitive emulsion in the $2^{nd}$ layer is EmB6 containing 0.4 g of $AgNO_3/m^2$.

Layer Structure 7 as layer structure 1, but the green-sensitive emulsion in the $4^{th}$ layer is EmG2 containing 0.23 g of $AgNO_3/m^2$.

Layer Structure 8 as layer structure 1, but with 0.15 g of yellow coupler V-54 and 0.40 g of yellow coupler V-52 instead of 0.55 g of yellow coupler V-1 and wit 0.23 g of magenta coupler III-2 instead of 0.23 of magenta coupler III-1.

Layer Structure 9 as layer structure 8, but the blue-sensitive emulsion in the $2^{nd}$ layer is EmB7 containing 0.4 g of $AgNO_3/m^2$.

Layer Structure 10 as layer structure 8, but the blue-sensitive emulsion in the $2^{nd}$ layer is EmB8 containing 0.4 g of $AgNO_3/m^2$.

Layer Structure 11 as layer structure 8, but the blue-sensitive emulsion in the $2^{nd}$ layer is EmB9 containing 0.4 g of $AgNO_3/m^2$.

Layer Structure 12 as layer structure 8, but the blue-sensitive emulsion in the $2^{nd}$ layer is EmB10 containing 0.4 g of $AgNO_3/m^2$.

Layer Structure 13

As layer structure 8, but the blue-sensitive emulsion in the $2^{nd}$ layer is EmB11 containing 0.4 g of $AgNO_3m^2$.

Layer Structure 14 as layer structure 8, but the blue-sensitive emulsion in the $2^{nd}$ layer is EmB12 containing 0.4 g of $AgNO_3/m^2$.

Layer Structure 15 as layer structure 8, but the blue-sensitive emulsion in the $2^{nd}$ layer is EmB13 containing 0.4 g of $AgNO_3/m^2$.

Layer Structure 16 as layer structure 1, but the blue-sensitive emulsion in the $2^{nd}$ layer is EmB14 containing 0.4 g of $AgNO_3/m^2$.

Layer Structure 17 as layer structure 8, but the blue-sensitive emulsion in the $2^{nd}$ layer is EmB15 containing 0.4 g of $AgNO_3/m^2$.

Layer Structure 18 as layer structure 8, but the blue-sensitive emulsion in the $2^{nd}$ layer is EmB16 containing 0.4 g of $gNO_3/m^2$.

Layer Structure 19 as layer structure 8, but the blue-sensitive emulsion in the 2nd layer is EmB17 containing 0.4 g of $AgNO_3/m^2$.

Layer Structure 20 as layer structure 8, but the blue-sensitive emulsion in the $2^{nd}$ layer is EmB18 containing 0.4 g of $AgNO_3/m^2$.

Compounds used for the first time in layer structures 1 to 20:

SC

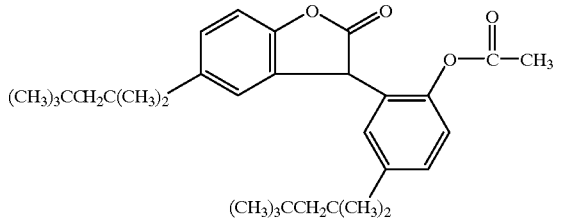

WK

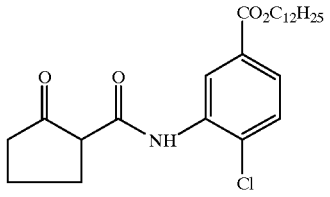

ST-3

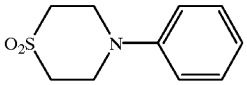

ST-4

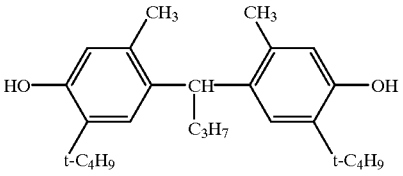

-continued

UV

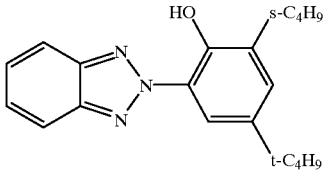

HM

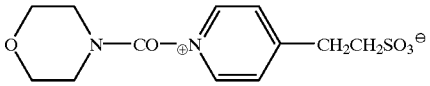

Processing:

Conventional (integral) Exposure:

The samples were exposed behind a graduated grey wedge with a density gradation of 0.1/step for 5 ms, 40 ms, 5 s and 40 s with a constant quantity of light and processed as follows using process AP 94:

a) Colour developer-45 s-35° C.

| | |
|---|---|
| Triethanolamine | 9.0 g |
| N,N-diethylhydroxylamine | 4.0 g |
| Diethylene glycol | 0.05 g |
| 3-Methyl-4-amino-N-ethyl-N-methanesulfonaminoethyl-aniline sulfate | 5.0 g |
| Potassium sulfite | 0.2 g |
| Triethylene glycol | 0.05 g |
| Potassium carbonate | 22 g |
| Potassium hydroxide | 0.4 g |
| Ethylenediaminetetraacetic acid, disodium salt | 2.2 g |
| Potassium chloride | 2.5 g |
| 1,2-Dihydroxybenzene-3,4,6-trisulfonic acid, trisodium salt | 0.3 g |
| make up with water to 1000 ml; pH 10.0. | |

b) Bleach/fixing bath-45 s-35° C.

| | |
|---|---|
| Ammonium thiosulfate | 75 g |
| Sodium hydrogen sulfite | 13.5 g |
| Ammonium acetate | 2.0 g |
| Ethylenediaminetetraacetic acid (iron/ammonium salt) | 57 g |
| Ammonia, 25 wt. % | 9.5 g |
| make up with acetic acid to 1000 ml; pH 5.5. | |

c) Rinsing-2 min-33° C.

d) Drying

The results from analogue exposure are presented in the form of the following parameters:

$D_{min}$: Density in the area of the colour density curve in the unexposed area Sensitivity, E: x coordinate at density=0.6 The x coordinate stated is the density of the target wedge (relative sensitivity value)

Gamma value G1: Threshold gradation: is the gradient of the secant between the sensitivity point at density $D=D_{min}+0.10$ and the curve point at density $D=D_{min}+0.85$.

Gamma value G2:Shoulder gradation: is the gradient of the secant between the sensitivity point at density $D=D_{min}+0.85$ and the curve point at density $D=D_{min}+1.60$.

$D_{max}$: Density of the area of the horizontal portion of the colour density curve on over-exposure.

Laser Exposure:

The samples were exposed in the above-stated laser film recorder with the half-tone step wedge and the solid step wedge:

| | | |
|---|---|---|
| Red: | minimum: | 0.7 nW |
| | maximum: | 25 μW |
| Green: | minimum: | 1 nW |
| | maximum: | 2 μW |
| Blue: | minimum: | 1 nW |
| | maximum: | 5 μW |

Processing is performed as for the analogue exposure.

The results of the laser exposures are presented in the form of the following parameters:

$D_F$ (red): Usable cyan maximum density at a tolerable line widening according to FIG. (3) and equation (3)

$D_F$ (green): as $D_F$ (red), but for magenta colour density $D_F$ (blue): as $D_F$ (red), but for yellow colour density Solarisation:

Performance: The unprocessed samples of layer structures 1 to 7 were exposed to sunlight (summertime, Europe) for 0.0 h, 0.5 h, 1 h, 2 h, 16 h and 48 h. The exposed samples were processed using process AP 94. The yellow, magenta and cyan colour densities were then measured using X-Rite (status A).

The results are reproduced in Tables 2a, 2b, 3a, 3b, 4a, 4b, 5a and 5b.

Result:

TABLE 2a

| Layer structure | Sensitive layer | Solarisation (0.5 h–0.0 h) | (1 h–0.0 h) | (2 h–0.0 h) | (16 h–0.0 h) | (48 h–0.0 h) | Usable $D_F$ on laser exposure $D_F$ (blue) | Note |
|---|---|---|---|---|---|---|---|---|
| 1 | yellow | −0.00 | −0.01 | −0.01 | −0.00 | −0.03 | 1.90 | Comparison |
| 2 | yellow | −0.00 | −0.00 | −0.00 | −0.01 | −0.02 | 1.95 | Comparison |
| 3 | yellow | −0.00 | −0.18 | −0.25 | −0.51 | −0.02 | 2.05 | Invention |
| 4 | yellow | −0.00 | −0.30 | −0.45 | −0.72 | −0.05 | 2.10 | Invention |
| 5 | yellow | −0.00 | −0.23 | −0.34 | −0.60 | −0.03 | 2.13 | Invention |
| 6 | yellow | −0.00 | −0.26 | −0.38 | −0.64 | −0.02 | 2.12 | Invention |

TABLE 2b

| Layer structure | Sensitive layer | Solarisation (0.5 h–0.0 h) | (1 h–0.0 h) | (2 h–0.0 h) | (16 h–0.0 h) | (48 h–0.0 h) | Usable $D_F$ on laser exposure $D_F$ (green) | Note |
|---|---|---|---|---|---|---|---|---|
| 1 | magenta | −0.00 | −0.00 | −0.00 | −0.01 | +0.01 | 2.23 | Comparison |
| 7 | magenta | −0.00 | −0.05 | −0.10 | −0.18 | −0.02 | 2.37 | Invention |

It is clear that materials having the solarisation characteristic achieve a higher usable density on laser exposure.

TABLE 3a

| Layer structure | Sensitive layer | Gamma 1 at exposure time 5 msec | 40 msec | 5 sec | Gamma 2 at exposure time 5 msec | 40 msec | 5 sec | Note |
|---|---|---|---|---|---|---|---|---|
| 1 | yellow | 1.65 | 1.80 | 1.78 | 2.62 | 3.00 | 2.98 | Comparison |
| 2 | yellow | 1.63 | 1.75 | 1.76 | 2.57 | 2.80 | 2.82 | Comparison |
| 3 | yellow | 1.73 | 1.76 | 1.76 | 2.75 | 2.85 | 2.85 | Invention |
| 4 | yellow | 1.74 | 1.76 | 1.76 | 2.87 | 2.90 | 2.90 | Invention |
| 5 | yellow | 1.75 | 1.77 | 1.77 | 2.90 | 2.95 | 2.95 | Invention |
| 6 | yellow | 1.72 | 1.76 | 1.77 | 2.83 | 2.89 | 2.88 | Invention |

TABLE 3b

| Layer structure | Sensitive layer | Gamma 1 at exposure time 5 msec | 40 msec | 5 sec | Gamma 2 at exposure time 5 msec | 40 msec | 5 sec | Note |
|---|---|---|---|---|---|---|---|---|
| 1 | magenta | 1.75 | 1.82 | 1.78 | 2.90 | 3.20 | 3.05 | Comparison |
| 7 | magenta | 1.81 | 1.84 | 1.82 | 3.18 | 3.22 | 3.17 | Invention |

It is clear that materials having the solarisation characteristic have better Schwarzschild behaviour with regard to gamma 1 and gamma 2.

TABLE 4a

| Layer structure | emulsion | Solarisation (0.5 h–0.0 h) | (1 h–0.0 h) | (2 h–0.0 h) | (16 h–0.0 h) | (48 h–0.0 h) | Usable $D_F$ on laser exposure $D_F$ (red) | $D_F$ (green) | $D_F$ (blue) | Note |
|---|---|---|---|---|---|---|---|---|---|---|
| 8 | EmB 1 | −0.00 | −0.01 | −0.01 | −0.00 | −0.04 | 2.47 | 2.38 | 1.95 | Comparison |
| 9 | EmB 7 | −0.00 | −0.00 | −0.00 | −0.01 | −0.03 | 2.46 | 2.39 | 2.00 | Comparison |
| 10 | EmB 8 | −0.00 | −0.16 | −0.25 | −0.40 | −0.02 | 2.48 | 2.41 | 2.25 | Invention |
| 11 | EmB 9 | −0.00 | −0.15 | −0.20 | −0.32 | −0.05 | 2.47 | 2.42 | 2.20 | Invention |
| 12 | EmB 10 | −0.00 | −0.22 | −0.38 | −0.40 | −0.03 | 2.46 | 2.44 | 2.15 | Invention |

TABLE 4b

| Layer structure | emulsion | Solarisation (0.5 h–0.0 h) | (1 h–0.0 h) | (2 h–0.0 h) | (16 h–0.0 h) | (48 h–0.0 h) | Usable $D_F$ on laser exposure $D_F$ (red) | $D_F$ (green) | $D_F$ (blue) | Note |
|---|---|---|---|---|---|---|---|---|---|---|
| 13 | EmB 11 | −0.00 | −0.01 | −0.01 | −0.00 | −0.03 | 2.44 | 2.38 | 1.90 | Comparison |
| 14 | EmB 12 | −0.00 | −0.00 | −0.25 | −0.51 | −0.02 | 2.43 | 2.40 | 2.00 | Invention |
| 15 | EmB 13 | −0.00 | −0.30 | −0.35 | −0.62 | −0.05 | 2.47 | 2.42 | 2.05 | Invention |
| 16 | EmB 14 | −0.00 | −0.13 | −0.24 | −0.50 | −0.03 | 2.46 | 2.43 | 2.08 | Invention |
| 17 | EmB 15 | −0.00 | −0.12 | −0.34 | −0.60 | −0.03 | 2.44 | 2.44 | 2.15 | Invention |

TABLE 4b-continued

| Layer structure | emulsion | Solarisation (0.5 h–0.0 h) | (1 h–0.0 h) | (2 h–0.0 h) | (16 h–0.0 h) | (48 h–0.0 h) | Usable $D_F$ on laser exposure $D_F$ (red) | $D_F$ (green) | $D_F$ (blue) | Note |
|---|---|---|---|---|---|---|---|---|---|---|
| 18 | EmB 16 | −0.00 | −0.15 | −0.37 | −0.60 | −0.02 | 2.43 | 2.47 | 2.20 | Invention |
| 19 | EmB 17 | −0.00 | −0.18 | −0.25 | −0.51 | −0.02 | 2.45 | 2.50 | 2.28 | Invention |
| 20 | EmB 18 | −0.00 | −0.30 | −0.45 | −0.72 | −0.05 | 2.47 | 2.46 | 2.20 | Invention |

It is clear that materials having solarisation characteristic achieve a higher usable density on laser exposure.

TABLE 5a

| Layer structure | emulsion | Gamma 1 at exposure time 5 msec | 40 msec | 5 sec | Gamma 2 at exposure time 5 msec | 40 msec | 5 sec | Note |
|---|---|---|---|---|---|---|---|---|
| 8 | EmB1 | 1.65 | 1.80 | 1.76 | 2.63 | 3.01 | 2.98 | Comparison |
| 9 | EmB7 | 1.62 | 1.75 | 1.76 | 2.82 | 3.05 | 3.05 | Comparison |
| 10 | EmB8 | 1.79 | 1.81 | 1.80 | 3.20 | 3.30 | 3.30 | Comparison |
| 11 | EmB9 | 1.76 | 1.78 | 1.76 | 3.22 | 3.25 | 3.25 | Invention |
| 12 | EmB10 | 1.74 | 1.75 | 1.77 | 3.10 | 3.15 | 3.15 | Invention |

TABLE 5b

| Layer structure | emulsion | Gamma 1 at exposure time 5 msec | 40 msec | 5 sec | Gamma 2 at exposure time 5 msec | 40 msec | 5 sec | Note |
|---|---|---|---|---|---|---|---|---|
| 13 | EmB11 | 1.65 | 1.80 | 1.78 | 2.62 | 3.00 | 2.95 | Comparison |
| 14 | EmB12 | 1.73 | 1.78 | 1.80 | 3.12 | 3.15 | 3.20 | Invention |
| 15 | EmB13 | 1.74 | 1.76 | 1.78 | 3.10 | 3.12 | 3.14 | Invention |
| 16 | EmB14 | 1.78 | 1.80 | 1.78 | 3.15 | 3.15 | 3.19 | Invention |
| 17 | EmB15 | 1.75 | 1.75 | 1.78 | 3.17 | 3.18 | 3.20 | Invention |
| 18 | EmB16 | 1.81 | 1.81 | 1.80 | 3.29 | 3.28 | 3.27 | Invention |
| 19 | EmB17 | 1.85 | 1.83 | 1.82 | 3.45 | 3.40 | 3.40 | Invention |
| 20 | EmB18 | 1.81 | 1.82 | 1.80 | 3.25 | 3.25 | 3.25 | Invention |

It is clear that materials having the solarisation characteristic have better Schwarzbild behaviour with regard to gamma 1 and gamma 2.

We claim:

1. A negatively developing color photographic silver halide material which comprises a support and at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler, at least 95 mol % of the silver halides contain AgCl, and at least one silver halide emulsion layer exhibits solarization on anaiogue exposure.

2. The color photographic silver halide material according to claim 1, wherein at least one silver halide emulsion layer contains a silver halide emulsion, the grains of which comprise at least two differently precipitated zones and the silver ratio of the outer zone to the remaining silver of the grains is 1/24 to 6/1.

3. The color photographic silver halide material according to claim 2, wherein the outermost zone is produced by recrystallizing a micrate emulsion onto the previously produced preliminary precipitate.

4. The color photographic silver halide material according to claim 2, wherein at least one zone of the stated silver halide emulsion is doped with at least one metal from Group VIII or IIB of the periodic system of elements or with Re, Au, Pb or TI.

5. The color photographic silver halide material according to claim 3, wherein the solvent is used for recrystallization of the micrate emulsion and said solvent is a bisthioether solution an NaCl solution or a mixture thereof.

6. The color photographic silver halide material according to claim 5, wherein the bisthioether is of the formula I

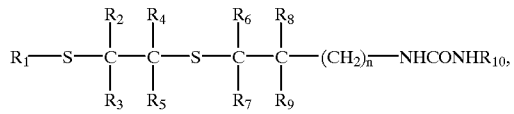

(I)

in which $R_1$ is an alkyl, alkenyl, cycloalkyl, aryl or aralkyl residue having no more than 8 C atoms or —C($R_6$, $R_7$)—C($R_8$, $R_9$)—$(CH_2)_n$NHCONH$R_{10}$ $R_2$ to $R_9$ mean H or alkyl having no more than 3 C atoms or, in pairs, the members of a five- or six-membered ring, $R_{10}$ means hydrogen or a substituent and n means 0 or 1.

7. The color photographic silver halide material according to claim 1, wherein the magenta coupler is of the formulae III or IV (III)

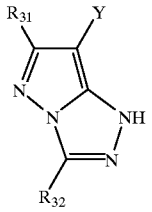

(IV)

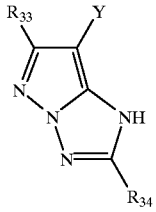

in which $R_{31}$, $R_{32}$, and $R_{34}$ mutually independently mean hydrogen, alkyl, aralkyl, aryl, aroxy, alkylthio, arylthio, amino, anilino, acylamino, cyano, alkoxycarbonyl, alkylcarbamoyl or alkylsulfamoyl, wherein these residues may be further substituted and wherein at least one of these residues contains a ballast group, and Y means a residue separable during chromogenic development (fugitive group) other than hydrogen.

8. The color photographic silver halide material according to claim 1, wherein the yellow coupler is of the formula V (V)

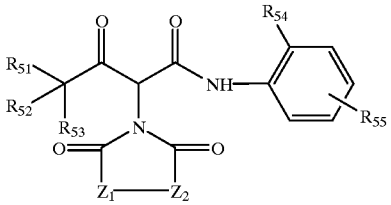

in which $R_{51}$, $R_{52}$, and $R_{53}$ mutually independently are alkyl or $R_{52}$ and $R_{53}$ together form a three-to six-membered ring;

$R_{54}$ is alkyl, alkoxy or halogen, $R_{55}$ is halogen, alkyl, alkoxy, aryloxy, alkoxcaroonyl, alkylsulfonyl, alkylcarbamoyl, arylcarbamoyl, alkylsulfamoyl, arylsulfamoyl;

$Z_1$ is —O—, —$NR_{56}$—;

$Z_2$ is —$NR_{57}$— or —$C(R_{58})R_{59}$—;

$R_{56}$, $R_{57}$, $R_{58}$ and $R_{59}$ mutually independently are hydrogen or alkyl.

9. The color photographic silver halide material according to claim 1, wherein the cyan couplerer is of the formula VI, VII or VIII (VI)

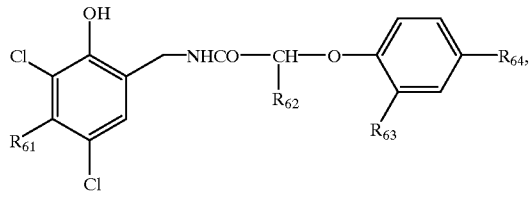

in which $R_{61}$, $R_{62}$, $R_{63}$ and $R_{64}$ mutually independent are hydrogen or $C_1$–$C_6$ alkyl;

(VII)

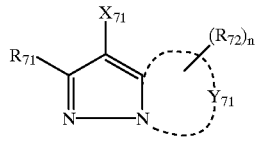

in which $R_{71}$ and $R_{72}$ mutually independently are an electron withdrawing group, $X_{71}$ is H or a residue separable during chromogenic development, $Y_{71}$ is a group for the completion of an nitrogen containing heterocycle with the proviso that $R_{72}$ is linked to a carbon atom of said heterocycle, and n is a number 1 or 2;

(VIII)

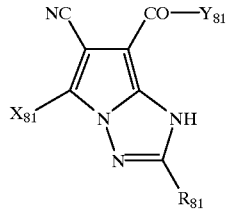

in which $R_{81}$ is H or a substituent, $X_{81}$ is H or a residue separable during chromogenic development, $Y_{81}$ is $OR_{82}$ or

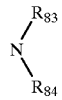

$R_{82}$ is

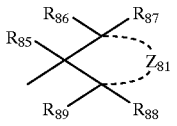

or alkyl, $R_{83}$ is alkyl, $R_{84}$ is H or $R_{83}$, $R_{85}$, $R_{86}$, $R_{88}$ and $R_{89}$ are identical or different and are H or a substituent, $R_{87}$ is a substituent and $Z_{81}$ is a group for the completion of a 3- to 8-membered ring, which is optionally substituted.

10. The color photographic silver halide material according to claim 4, wherein said doping metal is iridium, rhodium or mercury.

11. The color photographic silver halide material according to claim 4, wherein said doping metal is an inner zone of the silver halide emulsion is doped with $Hg^{2+}$ and an outer zone with $Ir^{3+}$, $Ir^{4+}$ and/or $Rh^{3+}$.

12. The color photographic silver halide material according to claim 1, wherein at least one silver halide emulsion layer contains at least 0.1 mmol AgI/mol AgCl.

13. The color photographic silver halide material according to claim 4, wherein the zone being doped with a metal of group VII or IIB is of the Periodic Systems of Elements contains simultaneous AgI.

14. The color photographic silver halide material according to claim 12, wherein the amount of AgI is 0.1 to 20 mmole/mole AgCl.

* * * * *